United States Patent [19]

Watanabe

[11] Patent Number: 4,868,918

[45] Date of Patent: Sep. 19, 1989

[54] IMAGE FORMING SYSTEM

[75] Inventor: Junji Watanabe, Yokohama, Japan

[73] Assignee: Kabushiki Kaisha Toshiba, Kawasaki, Japan

[21] Appl. No.: 871,543

[22] Filed: Jun. 6, 1986

[30] Foreign Application Priority Data

| | | | |
|---|---|---|---|
| Jun. 18, 1985 | [JP] | Japan | 60-132417 |
| Sep. 13, 1985 | [JP] | Japan | 60-202678 |
| Sep. 24, 1985 | [JP] | Japan | 60-210416 |
| Sep. 24, 1985 | [JP] | Japan | 60-210417 |
| Nov. 15, 1985 | [JP] | Japan | 60-256085 |
| Nov. 27, 1985 | [JP] | Japan | 60-266961 |

[51] Int. Cl.[4] ..... G03G 21/00

[52] U.S. Cl. ..... 355/233; 355/271

[58] Field of Search ..... 355/3 R, 5, 8, 11; 346/153.1, 160; 358/300

[56] References Cited

U.S. PATENT DOCUMENTS

| | | | |
|---|---|---|---|
| 3,597,071 | 7/1971 | Jones | 355/11 X |
| 4,027,961 | 6/1977 | Starkweather | 355/11 X |
| 4,110,030 | 8/1978 | Knechtel | 355/11 |
| 4,120,579 | 10/1978 | Maiorano | 355/11 |
| 4,134,668 | 1/1979 | Coburn | 355/3 R |
| 4,136,943 | 1/1979 | Koizumi | 355/5 |
| 4,154,524 | 5/1979 | Hattori et al. | 355/11 X |
| 4,170,412 | 10/1979 | Grace et al. | 355/5 |
| 4,194,833 | 3/1980 | Lester et al. | 355/3 R X |
| 4,646,249 | 2/1987 | Tanioka et al. | 355/5 X |
| 4,687,318 | 8/1987 | Shibasaki et al. | 355/5 |
| 4,723,138 | 2/1988 | Hashimoto et al. | 355/5 X |

FOREIGN PATENT DOCUMENTS

| | | |
|---|---|---|
| 2602545 | 1/1978 | Fed. Rep. of Germany . |
| 2165657 | 4/1986 | United Kingdom . |
| 2168822 | 6/1986 | United Kingdom . |

OTHER PUBLICATIONS

Cherian, "A Transparency Copying Machine", Xero Disclosure Journal, vol. 2, No. 3, May/Jun. 1977, pp. 69–70.

*Primary Examiner*—Fred L. Braun

*Attorney, Agent, or Firm*—Cushman, Darby & Cushman

[57] ABSTRACT

An image forming system includes a screen device having an image support element on which an image can be formed and a first scan unit optically scanning the image, and an image forming device, on which the screen device is arranged, which includes a document support element which can support a document thereon and a second scan unit optically scanning the document. The image forming device further includes a developing unit developing the electrostatic latent image pattern formed on an image carrier by light reflected from the image on the image support element and introduced into the image forming device from the image support element or by light reflected from the document arranged on the document support element thereby enabling the image forming system to copy not only the document arranged on the document support element but also the image formed on the image support element.

17 Claims, 30 Drawing Sheets

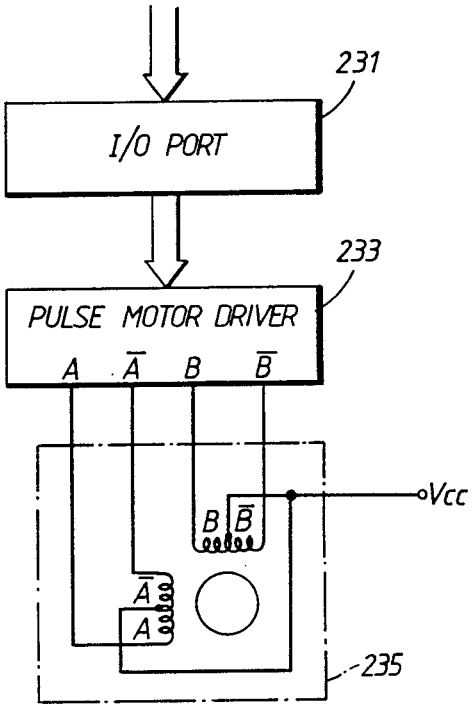
FIG.12.
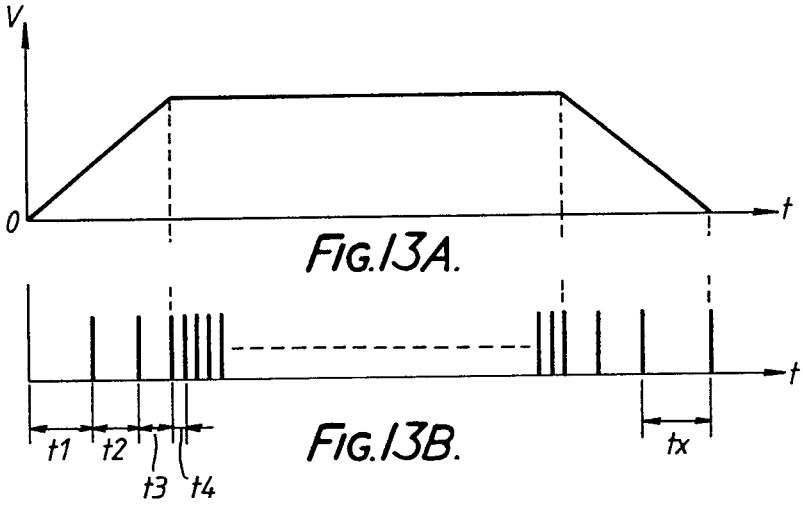
FIG.13A.
FIG.13B.

IMAGE FORMING SYSTEM

BACKGROUND OF THE INVENTION

1. Field of the Invention

The present invention relates in general to an image forming system. More specifically, the invention relates to an electronic copying machine which is able to copy an image formed on a screen which may be employed in the same manner as a blackboard.

2. Description of the Prior Art

Electronic copying machines are generally known which can enlarge or reduce the size of a document image as compared to the original. Well known copying machines, however, can copy only a document arranged on a document table.

It is also well known that large writing boards such as blackboards are often used in meetings. It is an inconvenience that characters and figures formed on a blackboard cannot be copied.

SUMMARY OF THE INVENTION

It is an object of the invention to provide an improved image forming system and method which can copy documents arranged on a document table as well as an image formed on a writing surface such as a screen.

It is another object of the invention to provide a unique image forming system and method which includes an image forming device and screen device (like a blackboard).

It is still another object of the invention to provide a screen device capable of being adapted to the conventional type of image forming device.

It is still another object of the invention to provide an image forming system and method which has an arrangement which moves a screen device arranged on the image forming device.

To achieve the above objects, there is provided an image forming system, e.g., a copy machine and method in which a screen device includes an image support member on which an image can be formed and a first scan member for optically scanning the image formed on the image support member as it moves relative to the image support member. An image forming device, on which the screen device is arranged, includes a document support member supporting a document and a second scan member for optically scanning the document arranged on the document support member as it moves relative to the document support member. An operation unit in the image forming device allows an operator to select between a copy of the image from the image support member and copy of the document arranged on the document support member. An image carrier forms an electrostatic charge pattern based on light reflected from the first scan member or second scan member and a developing unit develops the electrostatic charge pattern on the image carrier. In the image forming system and method, the screen device may be moved between a screen-position where the image formed on the first document support member can be copied and a conventional-position where the document arranged on the document support member can be copied.

BRIEF DESCRIPTION OF THE DRAWINGS

These and other objects and advantages of this invention will become more apparent and more readily appreciated from the following detailed description of the presently preferred exemplary embodiments of the invention, taken in conjunction with the accompanying drawings, wherein like reference numerals throughout the various figures denote like structure elements and wherein:

FIG. 12 is a block diagram showing a drive circuit for the pulse motor;

FIGS. 13A and 13B show characteristic diagrams depicting a speed control of the pulse motor;

DETAILED DESCRIPTION OF THE PREFERRED EXEMPLARY EMBODIMENTS

Figure 1:
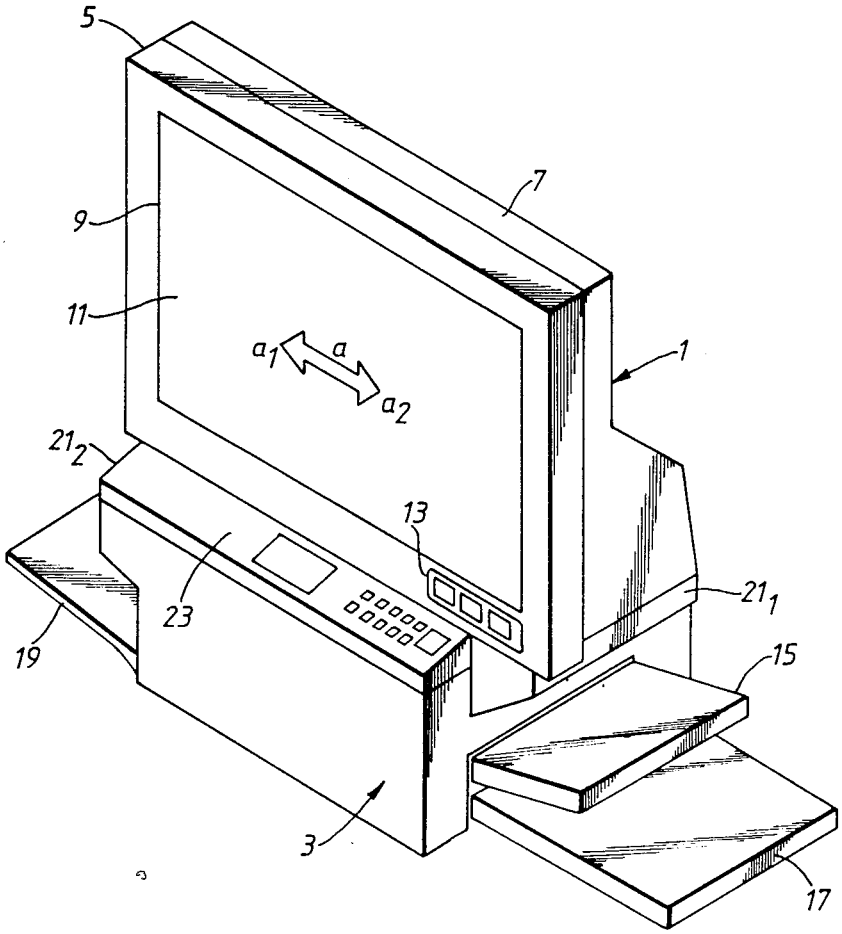
FIG. 1 is a perspective view illustrating the outer appearance of a first embodiment of an image forming system according to the present invention.
Figure 2:
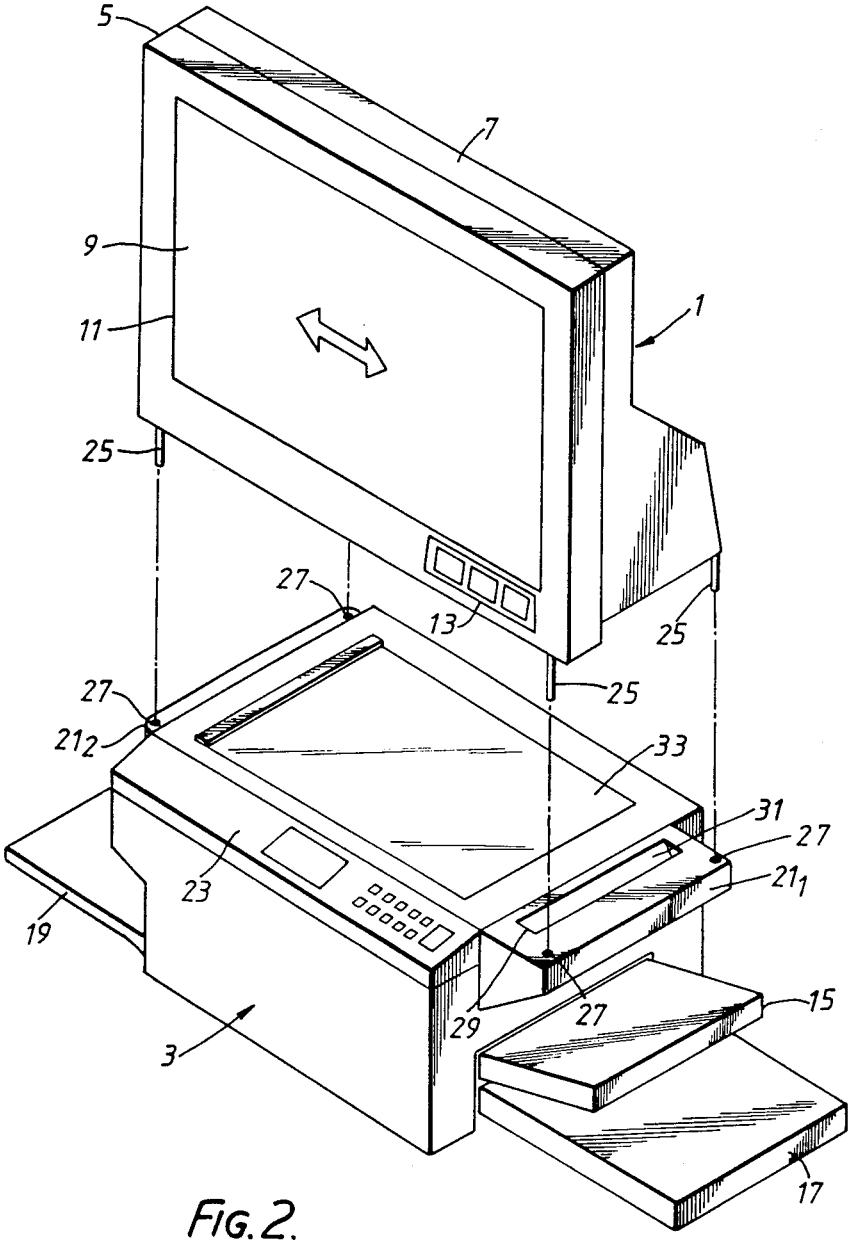
FIG. 2 is a perspective view illustrating the combination of a screen device and an image forming device in the embodiment.

Preferred embodiments of the present invention will now be described in more detail with reference to the accompanying drawings. FIGS. 1 and 2 show a construction of one embodiment of the image forming system embodying the present invention. A screen device 1 is detachably mounted on a copy machine 3, i.e., an image forming device. Screen device 1 is composed of a screen unit 5 and an optical unit 7 arranged at the backside of screen unit 5. A screen window 9, where a screen 11 is movably (in the directions $a_1$ and $a_2$ of the arrow a as shown in FIG. 1) arranged inside thereof, is formed to the front side of screen unit 5. A first operation panel 13 (as described hereafter) is arranged at the lower side of screen unit 5.

Upper and lower cassettes 15 and 17, in which copy sheets are contained, are removably inserted into the right lower portion of copy machine 3. A tray 19 is removably attached to the left lower portion of copy machine 3. A pair of supporting portions $21_1$ and $21_2$ individually project from the right and left upper portions of copy machine 3 to support screen device 1. Copy machine 3 also has a second operation panel 23 (as described hereafter) on the upper surface thereof.

As can be seen in FIG. 2, each corner of screen device 1 has an individual leg 25 firmly inserted into an individual hole 27 provided in supporting portions $21_1$ and $21_2$ of copy machine 3. An opening 29, through which light reflected from screen device 1 is introduced into copy machine 3, is provided in supporting portion $21_1$. A glass plate 31, which is arranged to make a right angle with an optical axis of the reflection light, is fitted into opening 29, thus perfectly preventing intrusion of any dust into copy machine 3. A document table 33 (a document supporting member) formed of a transparent glass is arranged on the upper surface of copy machine 3.

Figure 3:
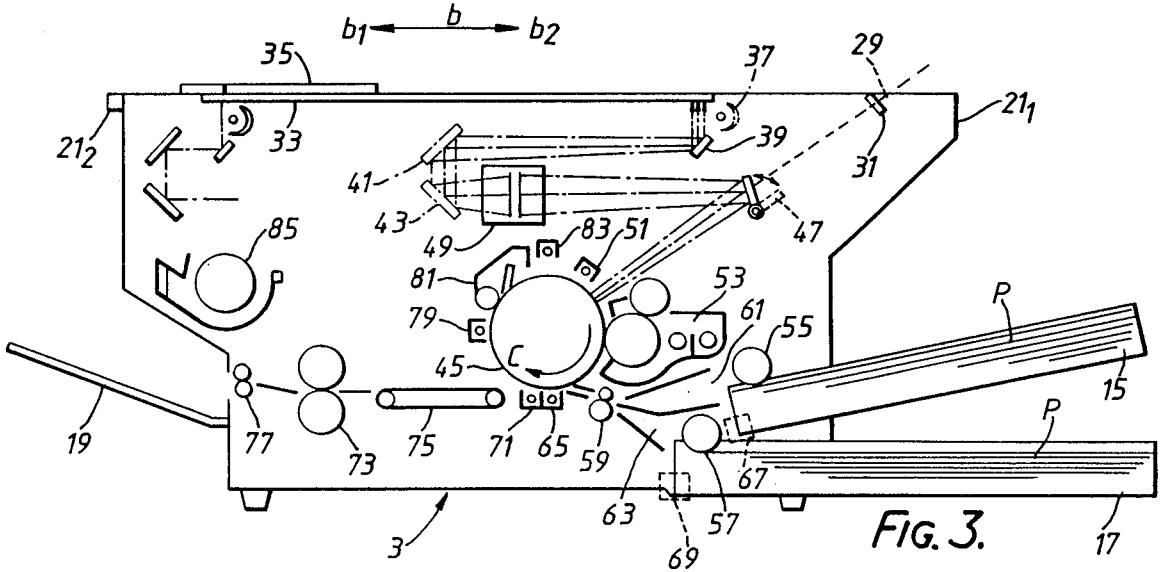
FIG. 3 is a schematic view illustrating a cross section of the image forming device shown in FIG. 2.

FIG. 3 is the schematic illustration of the structure of copy machine 3. Document 35 arranged on document table 33 is illuminated by an optical unit containing an exposure lamp 37 and mirrors 39, 41 and 43 when the optical unit moves in the directions of $b_1$ and $b_2$ of the arrow b. When exposure lamp 37 and mirror 39 move at speed V, mirrors 41 and 43 move at speed ½ V. The light from document 35 is reflected by mirrors 39, 41 and 43, and after that, the reflected light is directed to a photosensitive drum 45 by a movable mirror 47 (as described below) through a magnification changing lens block 49. At this time, photosensitive drum 45 is exposed to a slit light. Photosensitive drum 45 is rotated in the direction of arrow c which is synchronized with the scanning operation of the optical unit. Photosensitive drum 45 is charged with a positive charge by a charger 51. Then, photosensitive drum 45 is illuminated with the light reflected from document 35 to create an electrostatic latent image of the document on the surface thereof. Negatively charged toner is applied to the electrostatic latent image by a developer 53 to cause the latent image to become visible. Then, either upper cassette 15 or lower cassette 17 is selected and the copy sheets P contained therein are taken out sheet-by-sheet by means of a roller 55 (or 57). Each sheet is directed to a pair of aligning rollers 59 through either a guide 61 or a guide 63, thereby feeding each sheet between a transfer-charging device 65 and a photosensitive drum 45. Cassette size sensors 67 and 69 are provided in insertion holes for cassettes 15 and 17. Cassettes size sensors 67 and 69 each contain a plurality of microswitches which are turned on and off in response to the size of the inserted cassette.

The copy sheet P fed to the transfer part is in contact with photosensitive drum 45. Under this state, transfer-charging device 65 applies positive charges to the copy sheet and the toner image is transferred from photosensitive drum 45 onto the copy sheet. The copy sheet with the transferred toner image is then separated from photosensitive drum 45 by a separation-charging device 71, and is transferred to a pair of fixing rollers 73 by a transfer belt 75. Fixing roller pair 73 applies heat and pressure to the copy sheet, thereby fixing the toner image. After fixing, the copy sheet is discharged onto tray 19 by a pair of discharge rollers 77.

Photosensitive drum 45, after it is subjected t the toner transfer process, reaches a charge remover 79. Charge remover 79 removes charges on photosensitive drum 45. Further, the residual toner on the surface of drum 45 is removed by a cleaner 81, and an after image (residual charges) is erased by a discharge lamp 83. At this point, drum 45 is returned to its initial state.

To prevent an excessive temperature rise in copy machine 3, a cooling fan 85 is provided above discharge roller pair 77.

Figure 4:
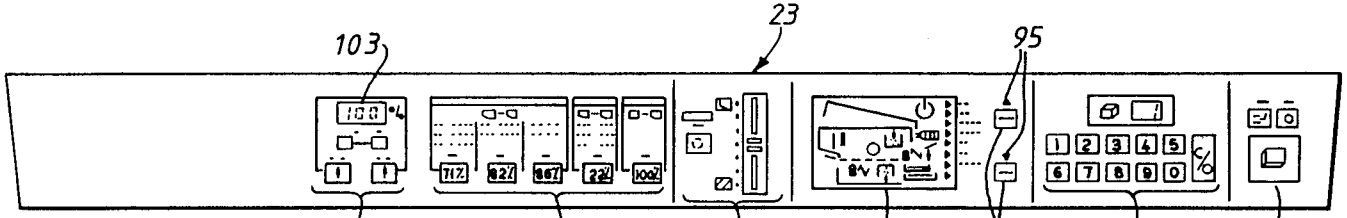
FIG. 4 is a plan view of an operation panel of the image forming device.

FIG. 4 shows a plan view of operation panel 23 provided on the upper surface of copy machine 3. As shown, a start key 87 for starting the copying operation, keyboard 89 for setting a desired number of copies, a pair of select keys 91 for selecting either upper cassette 15 or lower cassette 17 and a display 93 for displaying the operation-state of copy machine 3 with the progress of copying process and displaying also paper jam, etc., are arranged from right to left in the drawing. A pair of indicators 95 showing the selection of the cassettes are provided above select keys 91. A magnification key unit 97 for selecting enlarged or reduced copies of the original document in a prescribed relation is arranged on the left side of display 93. A gray level setter 99 for setting a gray level of the copy image is disposed on the right side of magnification key unit 97, and a zoom key unit 101 for setting the rate of enlargement or reduction without the constraint of a prescribed relation is disposed on the left side of magnification key unit 97. A rate display 103 showing the rate set by zoom key unit 101 is disposed above zoom key unit 101.

Figure 5:
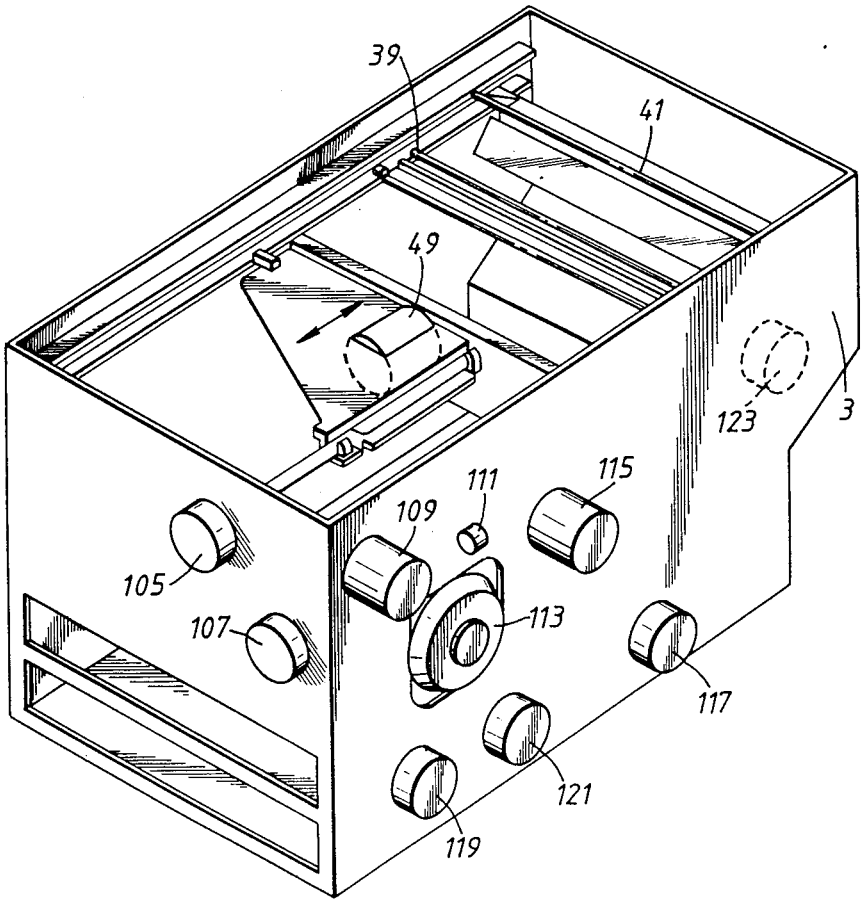
FIG. 5 is a perspective view illustrating how pulse motors as drive sources in the embodiment are allocated.

FIG. 5 shows an allocation of drive sources of copy machine 3 described above. The drawing of FIG. 5 is depicted as if viewed from the rear side of the copy machine 3, although FIG. 1 drawing shows the front side of the machine. A magnification changing motor 105 for changing the location of magnification changing lens block 49 is disposed on the left side of copy machine 3. A mirror drive motor 107 also is disposed on the same side as motor 105. Mirror drive motor 107 changes the distance (optical path) between mirror 39 and mirror 41 when the copy magnification is changed. A scanning motor 109 for moving exposure lamp 37 and mirrors 39, 41 and 43 to scan the document and a shutter motor 111 are disposed on the backside (front side shown in FIG. 5) of machine 3. The shutter motor moves the shutter (not shown) to adjust the charging width of the charge on photosensitive drum 45 provided by charge 51 when the copy magnification is changed. A developing motor 113 for driving the developing roller of developer 53, a drum motor 115 for driving photosensitive drum 45 and a fixing motor 117, are arranged on the backside of copy machine 3. The fixing motor drives transfer belt 75, fixing roller pair 73 and discharge roller pair 77. A paper supply motor 119 for driving feed rollers 55 and 57, a paper feed motor 121 for driving aligning roller pair 59 and a fan motor 123 for driving cooling fan 85 also are arranged on the backside of copy machine 3.

Figure 6:
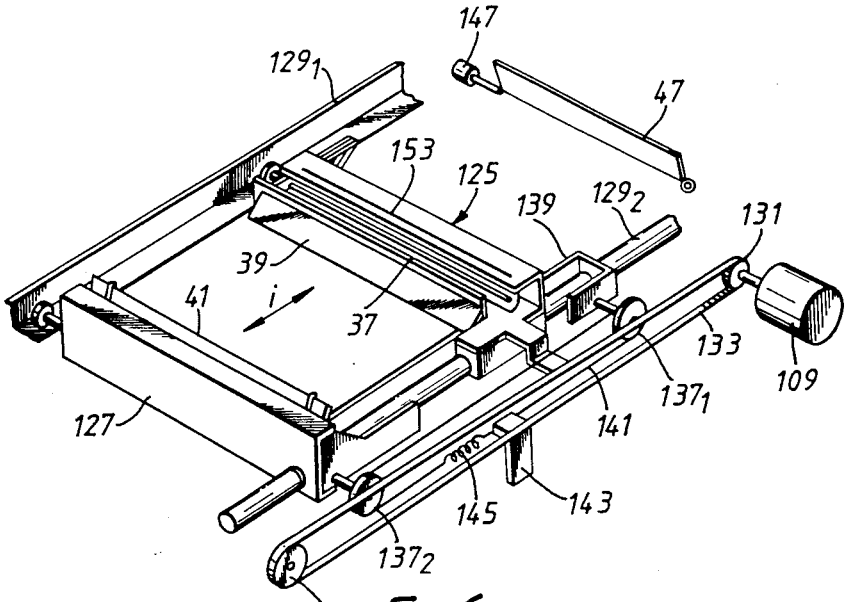
FIG. 6 is a perspective view of a scanning mechanism for moving an optical system of the image forming device in the embodiment.

FIG. 6 shows a scanning mechanism for reciprocating the optical unit composed of exposure lamp 37 and mirrors 39, 41 and 43 along document table 33. Mirror 39 and exposure lamp 37 are supported by a first carriage 125, and mirrors 41 and 43 by a second carriage 127. These carriages 125 and 127 can move in the direction of arrow i with guide rails $129_1$ and $129_2$. In more detail, the scanning motor 109 is a 4-phase pulse motor which drives a pulley 131. An endless belt 133 is wound around this pulley 131 and an idle pulley 135. First carriage 125 supporting mirror 39 is fixed at one end thereof to the mid-portion of endless belt 133. A couple of rotatable pulleys $137_1$ and $137_2$ are provided on guide 139 of first carriage 125 and on second carriage 127, respectively. A wire 141 extends between pulleys $137_1$ and $137_2$. One end of wire 141 is fixed to a fixed member 143, while another end is fixed to fixed member 143 through a coiled spring 145. One end of first carriage 125 is fixed to the mid-portion of wire 141. With the rotation of pulse motor 109, therefore, belt 133 rotates thus causing first carriage 125 to move. Second carriage 127 also moves in association with the movement of first carriage 125. At this time, as pulleys $137_1$ and $137_2$ serve as a fall block, second carriage 127 moves at half of the speed of first carriage 125 while travelling in the same direction as first carriage 125. The moving direction of first and second carriages 125 and 127 can be changed by reversing the rotating direction of pulse motor 109.

A rotation axle of a rotary solenoid 147 is fixed to the base portion of mirror 47, which can be rotated by rotation of rotary solenoid 147.

The area which can be copied, corresponding to the paper size designated, is displayed on document table 33. If the size of the paper selected by select key 91 is taken as ($P_x$, $P_y$), and the rate of the magnification designated by magnification key unit 97 or zoom key unit 101 as K, then, the area capable of being copied (x, y) is as follows:

$$X=P_x/K$$

$$Y=P_y/K$$

Figure 7:
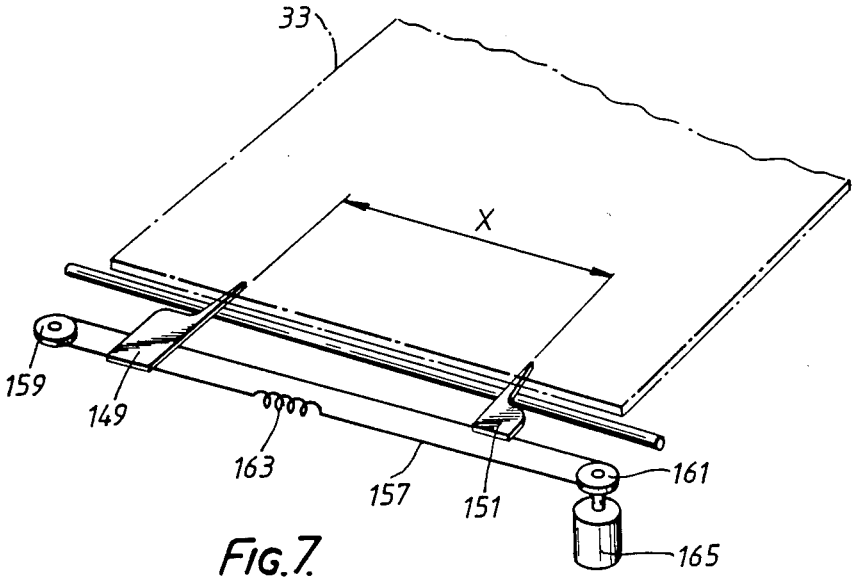
FIG. 7 is a perspective view illustrating in outline the drive mechanism of the pointers used for the image forming system.

In this area that can be copied (x, y), the x direction is indicated by pointers 149 and 151 (as shown in FIG. 7), while the y direction is indicated by scale 153 on the top of first carriage 125.

As can be seen in FIG. 7, pointers 149 and 151 are fixed to a wire 157 wound over pulleys 159 and 161 through a coiled spring 163. Pulley 161 is driven by a motor 165. The distance between pulleys 157 and 159 is changed by rotation of motor 165 in response to the selections of paper size and the magnification rate (enlargement/reduction rate). First carriage 125 is moved to a prescribed position by rotation of scanning motor 109 on the basis of the selection of paper size and the magnification rate. The prescribed position is, i.e., "home" position corresponding to the magnification rate. When start button is pressed, first carriage 125 is moved toward second carriage 127, and then as it is in the left most position in FIG. 3, exposure lamp 37 comes on, whereupon first carriage 125 is moved from this position toward its original position. During this movement, the document on document table 33 is irradiate by exposure lamp 37. When the scanning of the document is completed, exposure lamp 37 goes off, and first carriage 125 returns to its home position.

Figure 8:
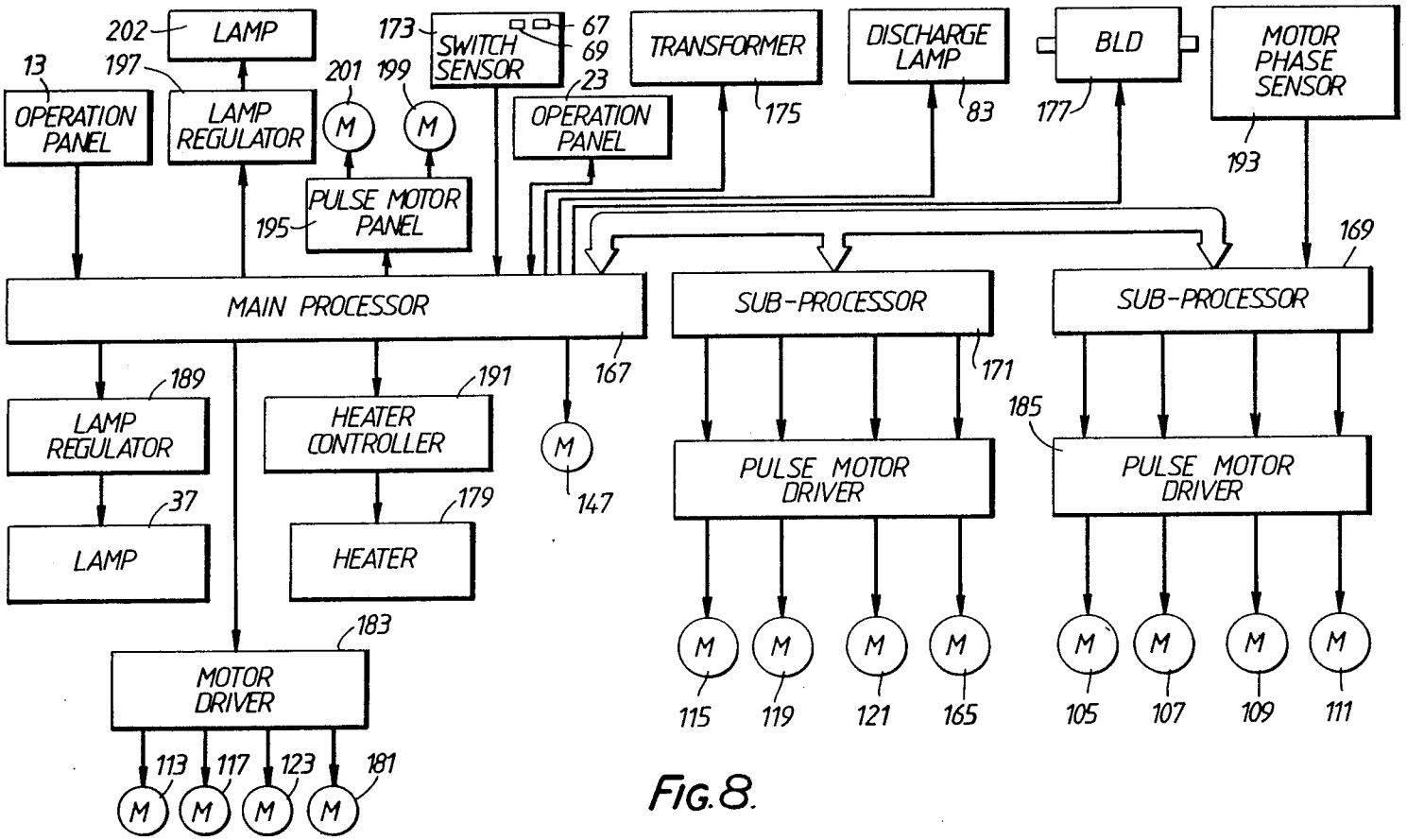
FIG. 8 is a control circuit diagram illustrating the electrical layout as a whole of this invention.

FIG. 8 shows the entire control circuit. The principal components of this circuit are a main processor 167 and first and second subprocessors 169 and 171. Main processor 169 executes the copying operation described above, by detecting the inputs from second control panel 23 and various input components 173, e.g., cassette size sensors 67 and 69, and by controlling a high voltage transformer 175 (which energizes various chargers), discharge lamp 83, a blade solenoid 177 of cleaner 81, a heater 179 of fixing roller pairs 73, exposure lamp 37 and motors 105–123 and 165. A toner motor 181 for feeding toner to developer 53 and motors 113, 117 and 123 are controlled by main processor 167 through a motor driver 183, motors 105, 107, 109 and 111 are controlled by first sub-processor 169 through a pulse motor driver 185. Motors 115, 119, 121 and 165 are controlled by second sub-processor 171 through a pulse motor driver 187. Exposure lamp 37 is controlled by main processor 167 through a lamp regulator 189. Heater 179 is controlled by main processor 167 through heater controller 191. 'Run' and 'stop' commands for the various motors are sent from main processor 167 to first and second sub-processors 169 and 171. While, from first and second sub-processors 169 and 171 to main processor 167, each status signal indicating a 'run' or a 'stop' state of individual motors is sent. Position information from a motor phase sensor 193, which detects each initial position of motors 105, is input to first sub-processor 169. First control panel 13 provided on screen device 1, a pulse motor driver 195, a lamp regulator 197 and a rotary solenoid 147 for driving mirror 47 are individually connected to main processor 167. Pulse motors 199 and 201 for moving screen 11 are connected to pulse motor driver 195. An exposure lamp 202 for illuminating screen 11 is connected to lamp regulator 197.

Figure 9:
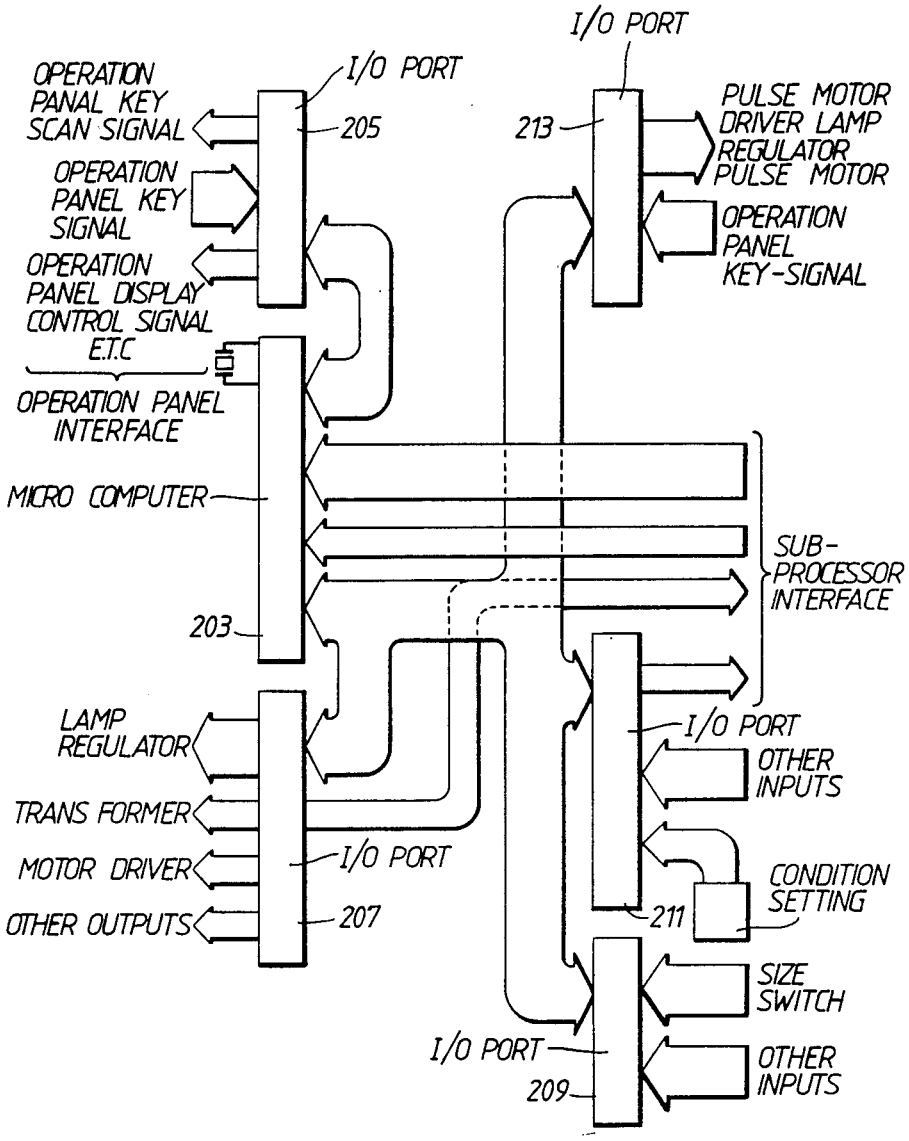
FIGS. 9 to 11 are respectively block diagrams showing a main processor, a first subprocessor, and a second sub-processor which are in the circuit of FIG. 8.

FIG. 9 shows an arrangement of main processor 167. One-chip microcomputer 203 detects key-in signal from second control panel 23 (not shown) through I/O port 205, and controls various displays. Microcomputer 203 is provided to I/O port 207, 209, 211 and 213. I/O port 207 is coupled with high voltage transformer 175, motor driver 183, lamp regulator 189 and other output. I/O port 209 is coupled with cassette size switches 67 and 69. I/O port 211 is coupled with a copy condition set switch (not shown) and other inputs. Microcomputer 203, thus, detects key-input data from first control panel 13 and controls exposure lamp and motors, corresponding to the key-input data, through I/O port 213.

Figure 10:
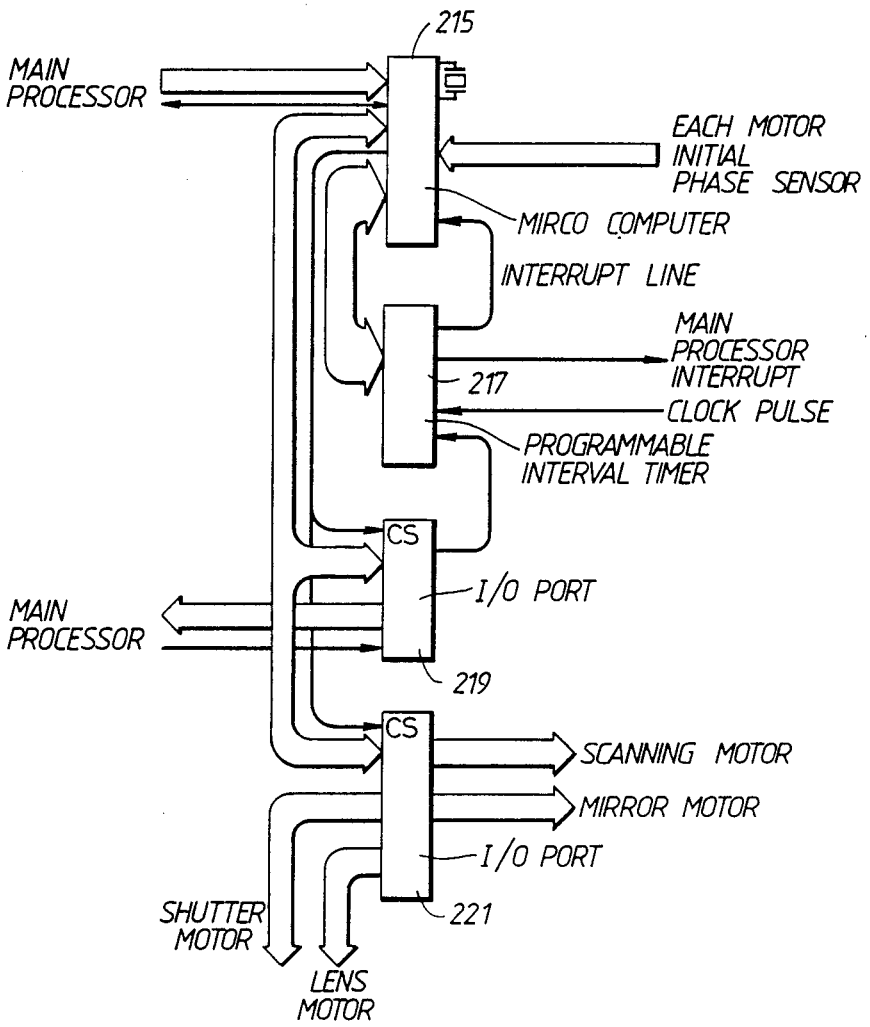

FIG. 10 shows an arrangement of first sub-processor 169. A microcomputer 215 which receives the position information of individual pulse motors is coupled with main processor 167. A programmable interval timer 217 is provided to control the time interval of the phase switching of the pulse motor. Programmable interval timer 217 starts its count operation when microcomputer 215 sets a set value thereto, and outputs its completion pulse into an interruption line of microcomputer 215 when its count operation is completed. Reference clock pulse data are input to programmable interval timer 217. I/O ports 219 and 221 are also coupled with microcomputer 215. I/O port 221 is coupled with motors 105, 107, 109 and 111 through pulse motor driver 185. I/O port 219 is used when microcomputer 215 outputs the status signals of individual pulse motors to main processor 167.

Figure 11:
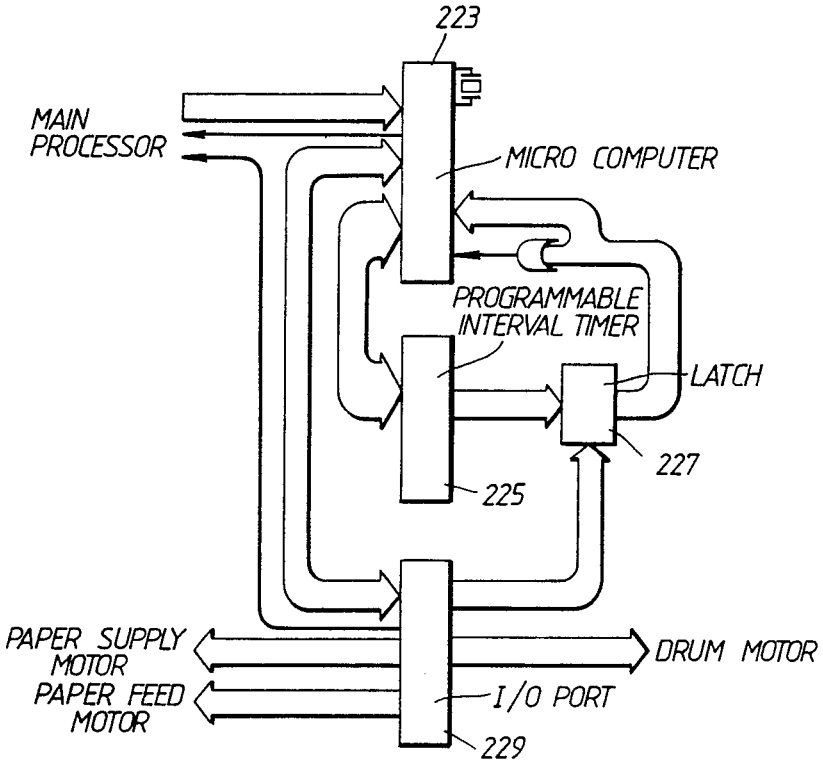

FIG. 11 shows an arrangement of second sub-processor 171. A microcomputer 223 is connected to main processor 167. A programmable interval timer 225 is provided to control the timer interval of the phase switching of the pulse motor. Programmable interval timer 225 starts its count operation when microcomputer 223 sets a set value thereto, and outputs its completion pulse when the count value reaches the set value. The completion pulse is latched in a latch circuit 227, the output signal of which is supplied to an interrupt line of microcomputer 223 and an input line of I/O port 229. I/O port 229 is connected to microcomputer 223 and is also connected to motor 115, 119, 121 and 165 through pulse motor driver 187.

FIG. 12 shows the control circuit for the pulse motors. As shown, an I/O port 231 (corresponding to I/O ports 221 and 229 in FIGS. 10 and 11) is coupled to a pulse motor driver 223 (corresponding to pulse motor drivers 185 and 187 in FIG. 8). The pulse motor driver 233 is connected to the windings A, A, B and B of a pulse motor 235 (corresponding to pulse motors 105, 107, 109, 111, 115, 119 and 121).

FIGS. 13A and 13B illustrate how the pulse motor's speed is controlled. FIG. 13A illustrates the speed curve of the pulse motor, and FIG. 13B illustrates the time intervals used in phase switching of the motor. As can be understood from the graph, the time interval used in phase switching is long at the initial stage, and gradually shorten, then becoming constant at the second stage. Next, the time interval becomes gradually longer again, and the motor finally stops. In other words, the curve illustrates the so-called through-up and through-down of the pulse motor, as it rises from the self-starting region, passes the high-speed region which is used in the motor operation, and falls down. In this figure, $t_1$, $t_2 \ldots t_x$ show the time interval for phase switching.

Figure 14:
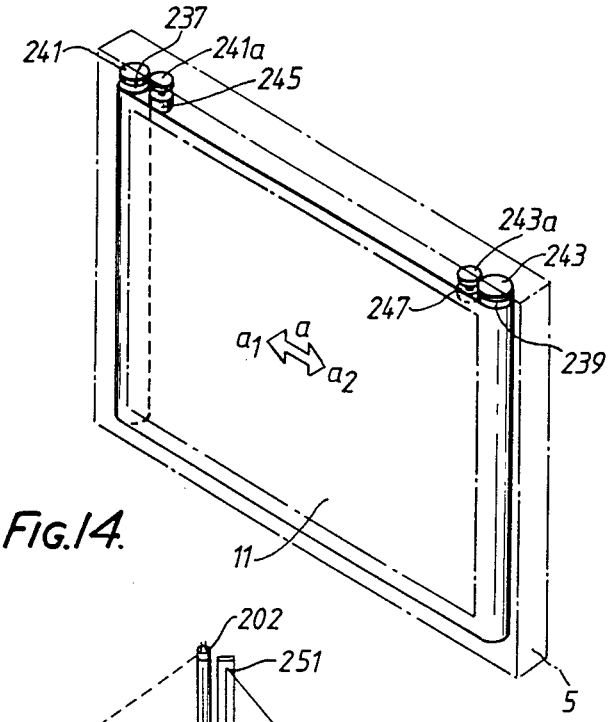
FIG. 14 is a perspective view showing a screen arrangement of the screen device.
Figure 15:
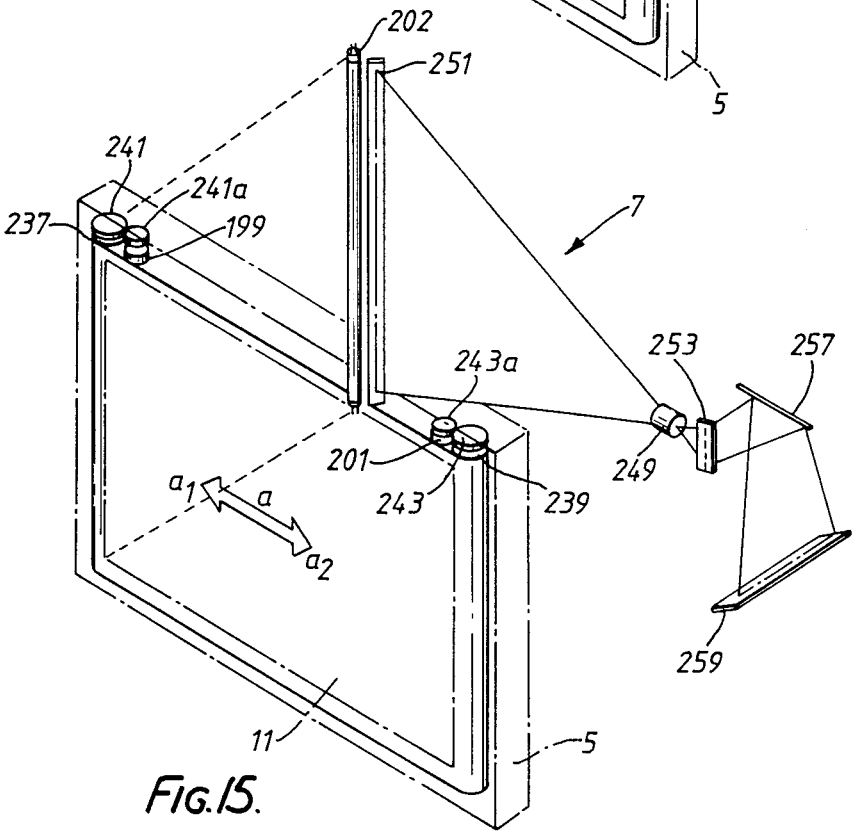
FIG. 15 is a perspective view showing how the screen arrangement and an optical arrangement are combined.

The constitution of screen device 1 is now described hereafter. FIGS. 14 and 15 show the arrangements of screen unit 5 and optical unit 7. Screen 11 may be made of a material which allows an operator to write images thereon. Screen 11 is wound at both ends to individual hubs 237 and 239. One end of hubs 237 and 239 are provided with gears 241 and 243, respectively. Individual gears 241 and 243 are operatively coupled with corresponding gears 241*a* and 243*a* which are driven by motors 199 and 201, respectively. Screen 11, therefore, is moved in the directions $a_1$ or $a_2$ of arrow a by driving motor 199 or 201 selectively.

Figure 16:
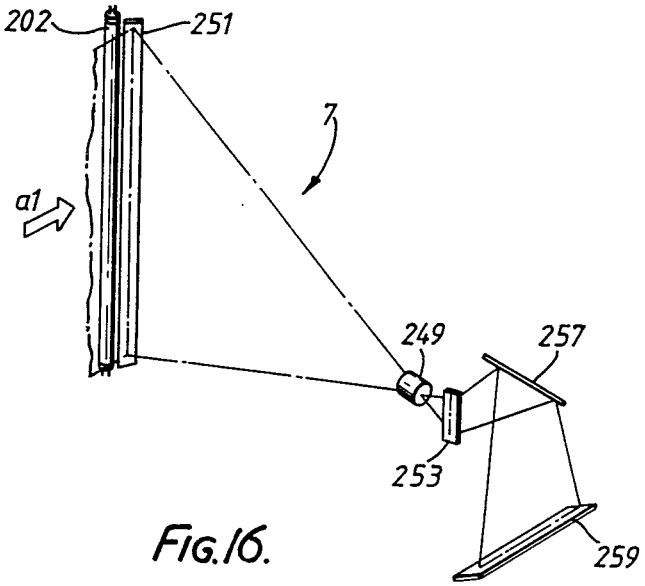
FIG. 16 is a perspective view showing the optical arrangement shown in FIG. 15.
Figure 17:
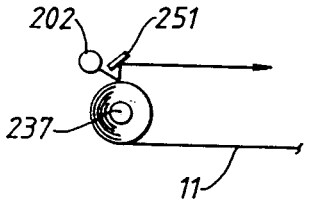
FIG. 17 is a plan view showing how a document formed on a screen is scanned.
Figure 18:
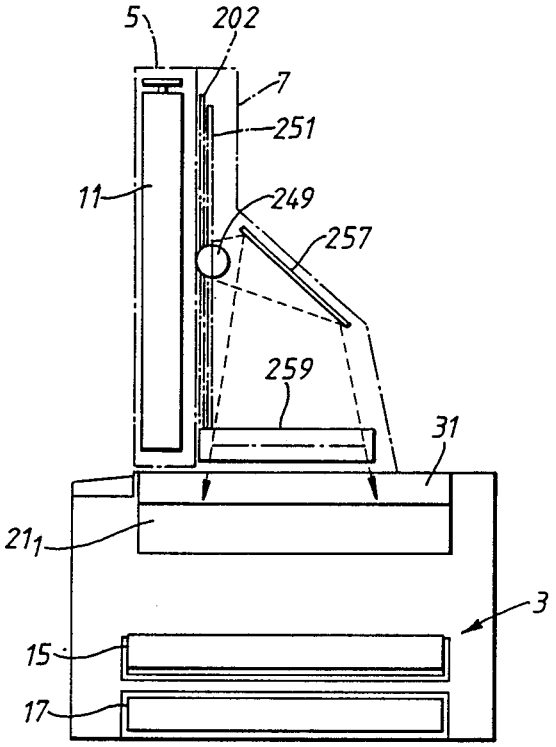
FIG. 18 is a side view illustrating an optical path of the screen device.

As can be seen in FIG. 15, exposure lamp 202, a lens 249 and mirrors 251, 253, 257 and 259 are disposed in the inside optical unit 7. Exposure lamp 202 and mirror 251, as shown in FIG. 15, are arranged near hub 237 along the width of screen 11. As can be seen in FIGS. 16 and 17, the light from exposure lamp 202 illuminates the surface of screen 11 wound around hub 237. The light reflected from screen 11 is also reflected by mirror 251 to be directed to lens 249. After that, the reflected light is reflected by mirrors 253, 257 and 259. At the same time, the reflections cause the width of the reflected light to be reduced in correspondence to that of copy sheet P. Then the reflected light is directed into copy machine 3 from opening 29 of supporting portion $21_1$ as shown in FIG. 18.

Figure 19:
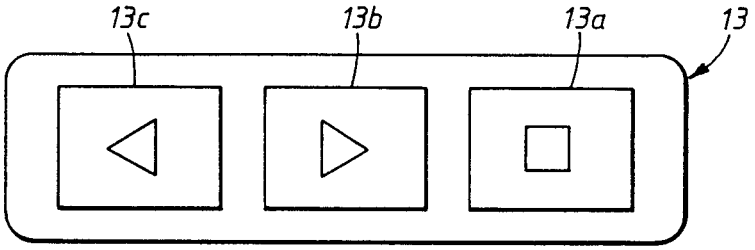
FIG. 19 is a plan view showing an operation panel of the screen device.

FIG. 19 illustrates first operation panel 13 arranged at the lower front part of screen unit 5 of screen device 1. Panel 13 includes a copy key 13*a* for starting a copy of the image formed on screen 11, a right-move key 13*b* for moving screen 11 in a right direction by having hub 239 wind screen 11 and a left-move key 13*c* for moving screen 11 in a left direction by having hub 237 wind screen 11.

The operation of the above-described construction will be given hereinafter. When left-move key 13 of control panel 13 is operated, pulse motor driver 195 is controlled by main processor 167. Pulse motor driver 195 then drives pulse motor 199 to wind up screen 11 around hub 237. While, when right-move key 13*b* is operated, pulse motor driver 195 is controlled by main processor 167. By this operation, pulse motor driver 159 drives pulse motor 201 to wind up screen 11 around hub 239.

Figure 20:
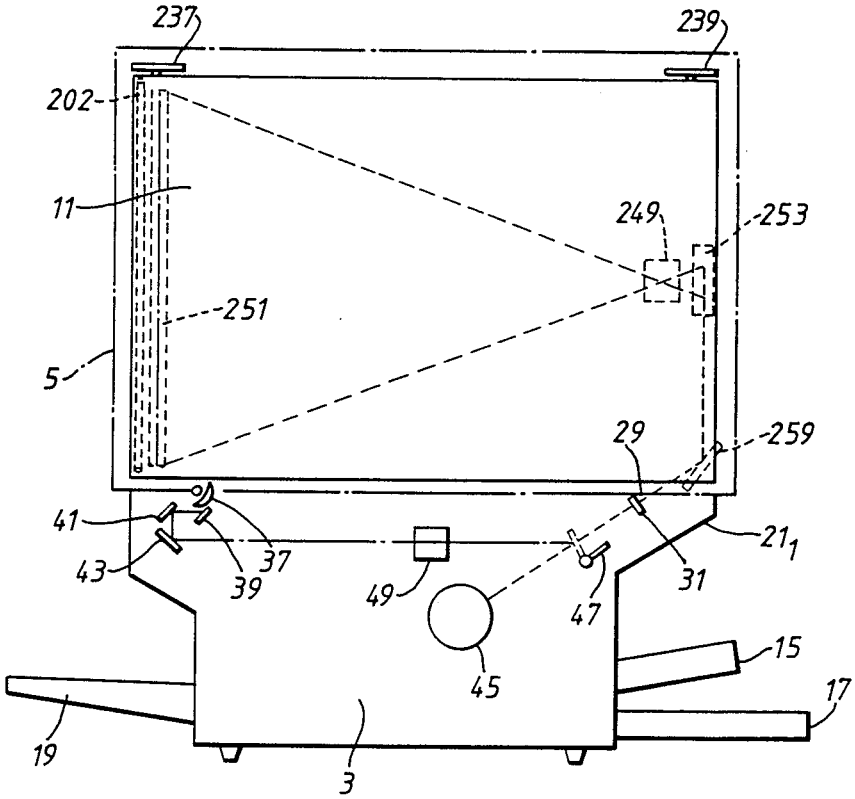
FIG. 20 is a front view illustrating an entire optical path of the embodiment.
Figure 21:
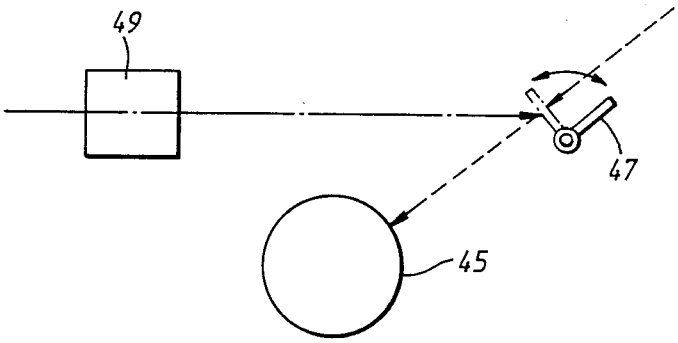
FIG. 21 is a front view illustrating how a mirror mechanism is operated.

When copy key 13*a* is operated, pulse motor driver 195, lamp regulator 189 and rotary solenoid 147 are controlled by main processor 167. In more detail, rotary solenoid 147 moves mirror 47 to a first position where mirror 47 does not hinder the light fed from screen device 1 through opening 29 as shown in FIGS. 20 and 21. After that, exposure lamp 202 is turned on by lamp regulator 197 and then, pulse motor 199 is driven by pulse motor driver 195 to wind up screen 11 around hub 237. At this time, since screen 11 is wound up by pulse motor 199 in synchronism with the rotation of photosensitive drum 45, the image (characters and figures) formed on screen 11 is illuminated by exposure lamp 202 during the winding. Also, the operation of copy key 13*a* causes main processor 167 to stop the operations of motors 105, 107, 109 and 111, lamp regulator 189 and the optical unit composed of magnification lens block 49, mirrors 39, 41 and 43 and exposure lamp 37.

The light reflected from screen 11, after being reflected by mirror 251, is directed through lens 249 and is reflected by mirrors 253, 257 and 259. After that, the reflected light is directed into copy machine 3 through opening 29, and then illuminates photosensitive drum 45 to create an electrostatic latent image of the image on the surface of the drum. The electrostatic latent image on drum 45 is transferred from drum 45 onto the copy sheet as mentioned before, and then the copy sheet is discharged to tray 19.

Though the copying operation of an image on screen 11 has been described above, by this system including screen device 1 and copy machine 3, a document arranged on document table 33 also can be copied. In this case, mirror 47 is moved to a second position where the light reflected from the document can be directed to photosensitive drum 45.

According to the above-described embodiment, since screen device 1 is arranged on copy machine 3, the document on screen 11 can be copied by an operation similar to that of a conventional copy machine, thus it is very convenient to use this system in meetings. Further, no extra space is needed because of screen device 1 arranged on copy machine 3. In addition, since screen 11 is moved in synchronism with the rotation of photosensitive drum 45, the copy speed is fast.

Figure 22:
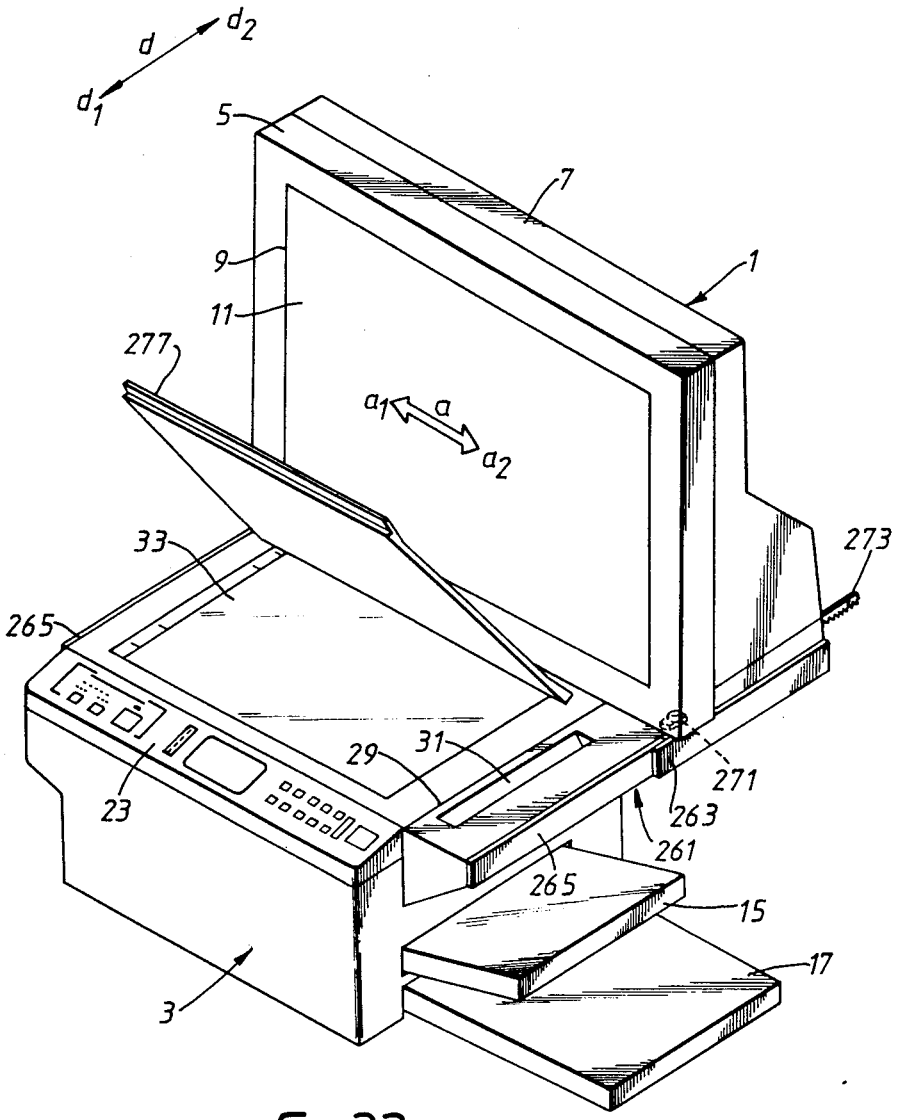
FIG. 22 is a perspective view illustrating the outer appearance of a second embodiment of an image forming system according to the present invention.

A second embodiment, of the present invention will now be described. FIG. 22 shows an overall view of a second embodiment of the image forming system embodying the invention. In this embodiment, screen device 1 is movably mounted on copy machine 3. A sliding means 261 is composed of a pair of moving rails 263 respectively projecting from the bottom surface of screen device 1 and a pair of rails 265 fixed to the upper part of opposite side portions of copy machine 3. Moving rail pair 263 is so arranged that it moves along fixed rail pair 265 when screen device 1 is moved in the directions $d_1$ and $d_2$ of arrow d as shown in FIG. 22.

Figure 23:
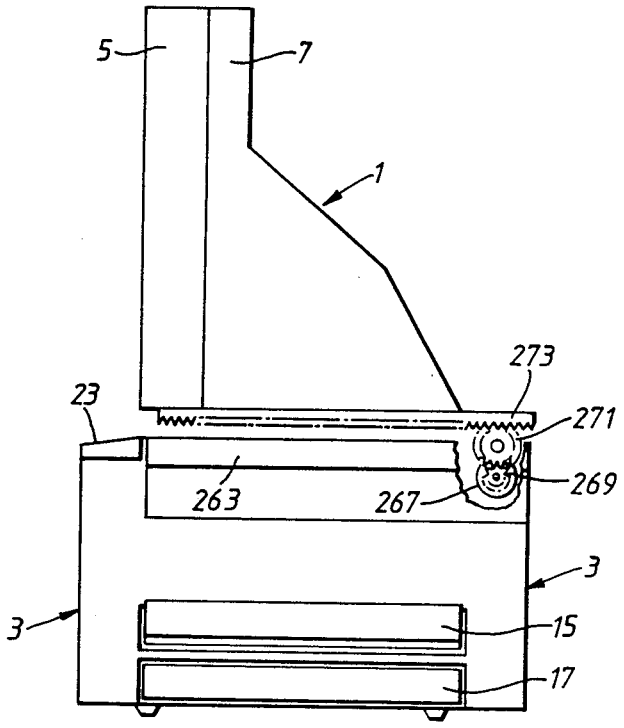
FIGS. 23 and 24 are side views in partly section illustrating the second embodiment shown in FIG. 22.
Figure 24:
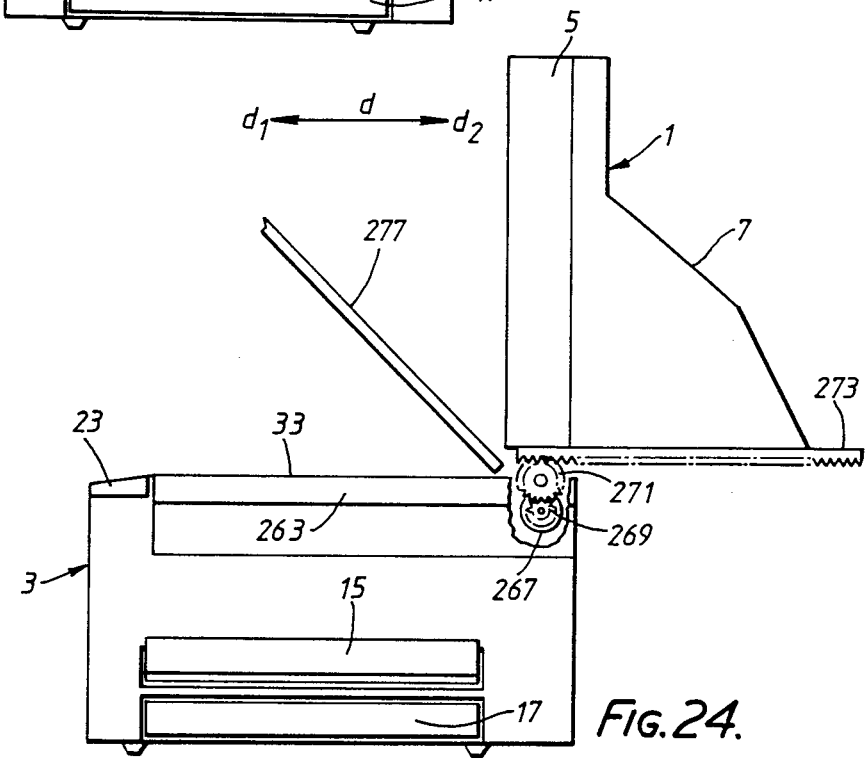

As can be seen in FIGS. 23 and 24, a pulse motor 267, which is provided in copy machine 3, is disposed near moving rail 263 of screen device 1. A gear 269 fixed to the rotation axis of pulse motor 267 is operably coupled with a pinion 271. While, a rack 273, which is coupled with pinion 271, is attached to the bottom surface of screen device 1. Therefore, when pinion 271 is rotated by pulse motor 267 through gear 269, screen device 1 can be slidably moved along fixed rail pair 265 in the directions $d_1$ and $d_2$ of arrow d by moving rack 273 in response to the rotation of pinion 271.

Figure 25:
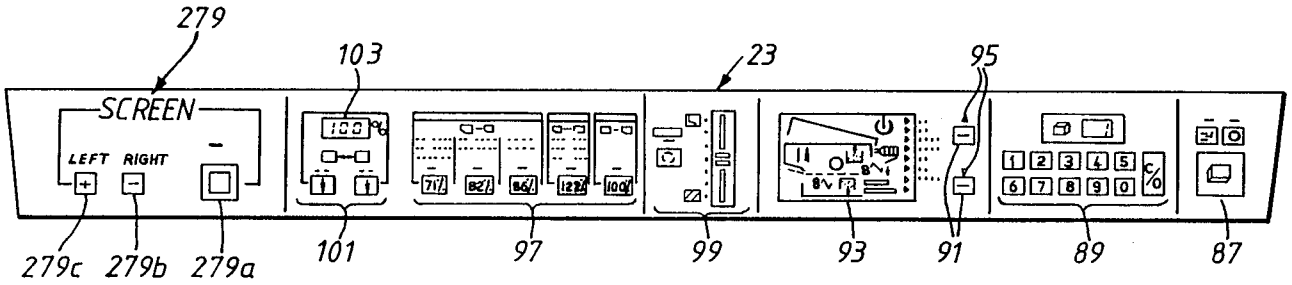
FIG. 25 is a plan view of an operation panel of the image forming device of second embodiment.

In more detail, when screen device 1 is moved to the rear-most position as shown in FIGS. 22 and 24, the document arranged between document table 33 and cover 277 can be copied (hereafter referred to as "Conventional mode"). While, when screen device 1 is moved to the front-most position, the document formed on screen 11 can be copied (hereafter referred to as "Screen mode"). The movement of screen device 1 is automatically carried out by pulse motor 267 which is controlled by a screen control unit 279. As can be seen in FIG. 25, screen control unit 279 is arranged on second control panel 23 at the left-most portion. Screen operation unit 279 is composed of a selection key **279*a*, a right-move key 279*b* and left-move key 279*c*. The "Conventional mode" and "Screen mode" can be selected by operating selection key 279*a*. Screen 11 also can be moved by operating keys 279*b* and 279*c***.

According to the second embodiment described above, since screen device 1 can be automatically moved by the operation of selection key **279*a***, the ease of operation of this system is enhanced.

Figure 26:
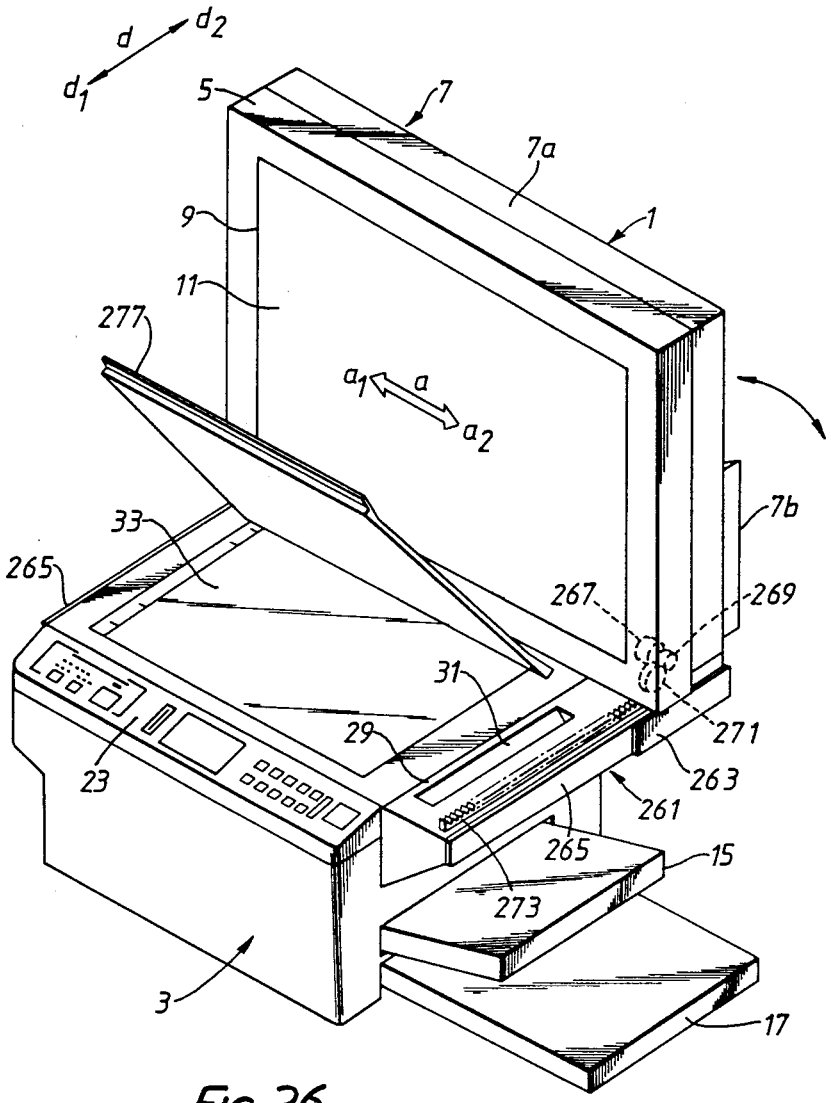
FIG. 26 is a perspective view illustrating the outer appearance of a third embodiment of an image forming system according to the present invention.

Next, a third embodiment of the present invention will be described with reference to FIGS. 26 to 30. In this embodiment, a drive means 281 including pulse motor 267 and pinion 271 is arranged in screen device 1 instead of copy machine 3 as shown in FIG. 26, while, rack 273, which is coupled with pinion 271, is disposed on the surface of copy machine 3 instead of screen device 1. Therefore, screen device 1 of this embodiment also can be moved by operating screen operation unit 279 as shown in FIG. 25.

Figure 27:
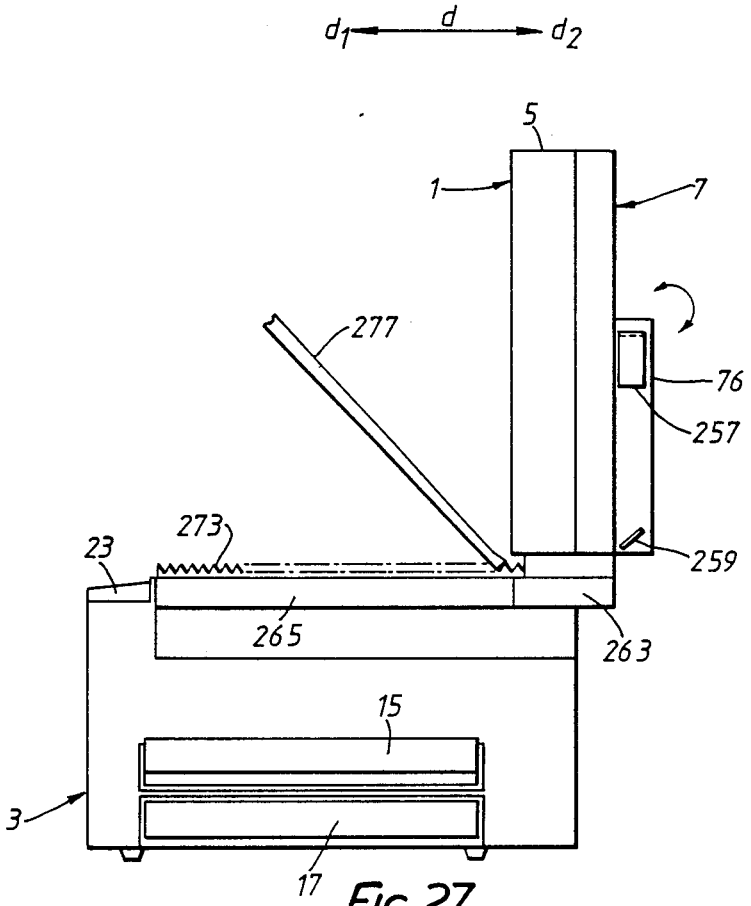
FIG. 27 is a side view of the image forming system when a screen device is at a conventional-position.
Figure 28:
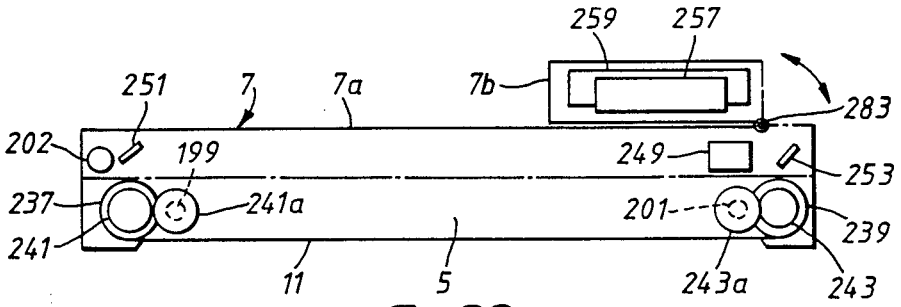
FIG. 28 is a plan view illustrating the screen device shown in FIG. 27.
Figure 29:
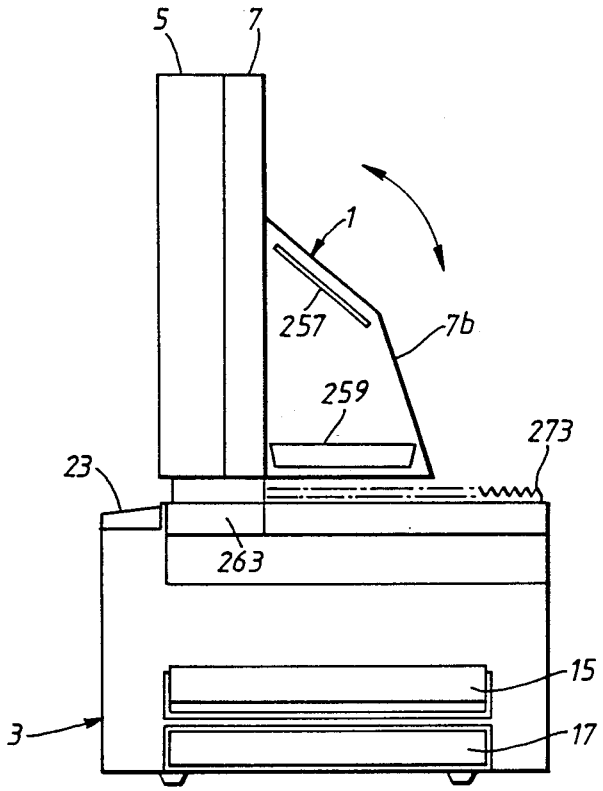
FIG. 29 is a side view of the image forming system when the screen device is at a screen position.
Figure 30:
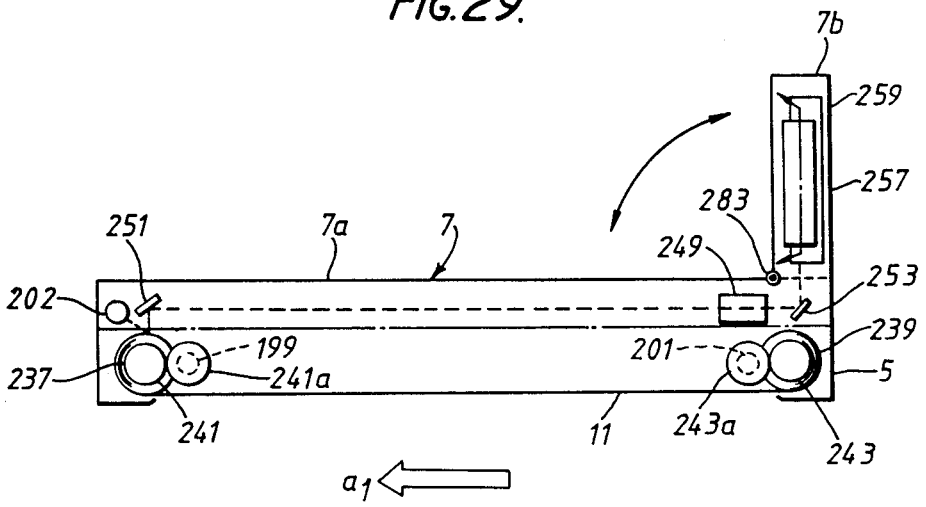
FIG. 30 is a plan view illustrating the screen device shown in FIG. 29.

In addition, in this embodiment, optical unit 7 of screen device 1 is composed of a first optical unit **7*a* and a second optical unit 7*b*. First optical unit 7*a* is arranged at the backside of screen unit 5, while second optical unit 7*b* is attached to first optical unit 7*a* by means of hinge 283 as shown in FIGS. 28 and 30. Thus, second optical unit 7*b* can be rotated around hinge 283. First optical unit 7*a* is composed of mirror 251, lens 249 and mirror 253, while second optical unit 7*b* is composed of mirrors 257 and 259. When screen device 1 is moved to the rear-most position ("conventional mode"), second optical unit 7*b* may be rotated to the position where second optical unit 7*b* is in parallel with first optical unit 7*a* as shown in FIGS. 27 and 28. Under this state, the document on document table 33 can be copied. When screen device 1 is moved to the front-most position ("screen mode"), on the other hand, second optical unit 7*b* may be rotated to the position where second optical unit 7*b* is at a right angle to first optical unit 7*a* as shown in FIGS. 29 and 30. In this state, a suitable light-path extending from mirror 251 to photosensitive drum 45 (as shown in FIG. 3) through mirror 259 is established, thus the document formed on screen 11** can be copied.

According to the third embodiment of this invention, since second optical unit **7*b*, which is part of the first optical means, can be rotated by hinge 283, the depth of optical unit 7 can be minimized. In addition, screen device 1 can be automatically moved by the operation of selection key 279*a***, thus the ease of operation of the apparatus can be enhanced.

Figure 31:
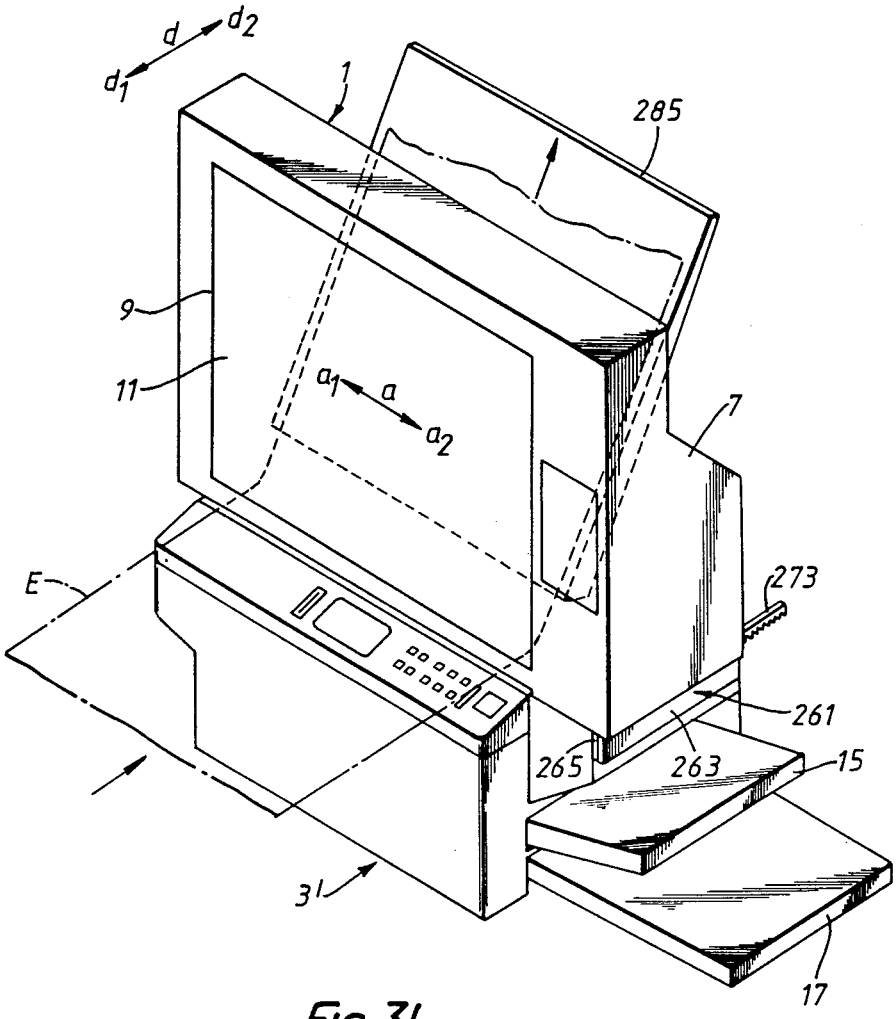
FIG. 31 is a perspective view illustrating the outer appearance of a fourth embodiment of an image forming system according to the present invention.
Figure 32:
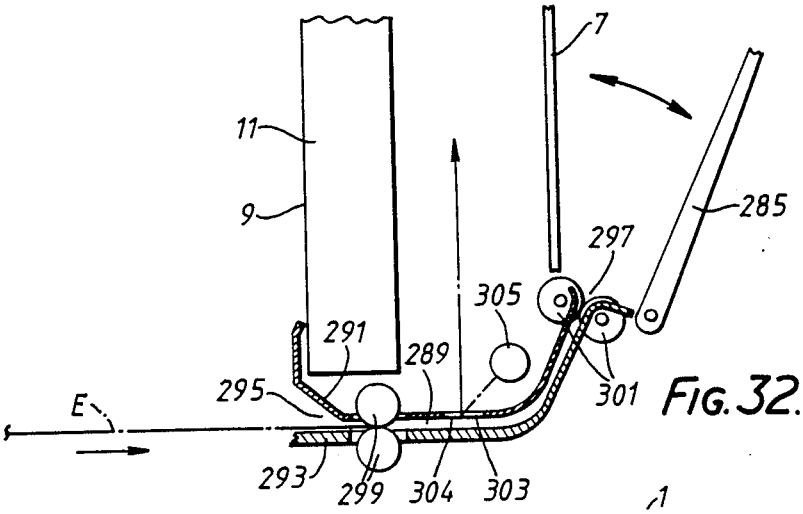
FIG. 32 is a longitudinal sectional view showing a conveyance arrangement used in the fourth embodiment.

FIG. 31 shows a fourth embodiment of the present invention. In this embodiment, a large sheet document E can be copied. The large sheet document is fed from the front side of screen device 1 to a tray 285 which is attached to the backside of screen device 1. The constitution of a conveyance means 287 is described in more detail with reference to FIG. 32. A transfer path 289 for transferring a document sheet E, the size of which is larger than that of the document on document table 33, is formed by first and second path members 291 and 293 at the bottom of screen device 1. An intake port 295 for receiving the document sheet E is formed at the left side of transfer path 289, while a discharge port 297 is formed at the right side of transfer path 289 in FIG. 32. A pair of feeding rollers 299 is disposed near intake port 295 to feed the document sheet E into transfer path 289. While a pair of discharge rollers 301 is arranged near discharge port 297 to discharge the document sheet E from transfer path 289. One end of tray 295 described above is rotatably hinged near discharge port 297. A light illumination opening 303 is provided to first transfer path 291 between intake roller pair 299 and discharge roller pair 301. A transparent plate 304 is fitted in light illumination opening 303 to prevent dust from entering into screen device 1.

Figure 33:
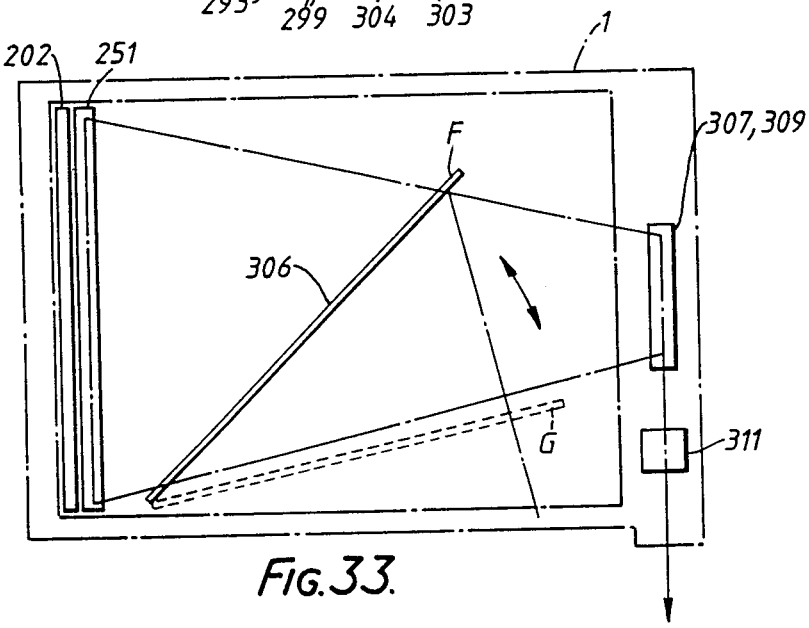
FIG. 33 is a front view illustrating how an optical path is established in the fourth embodiment.
Figure 34:
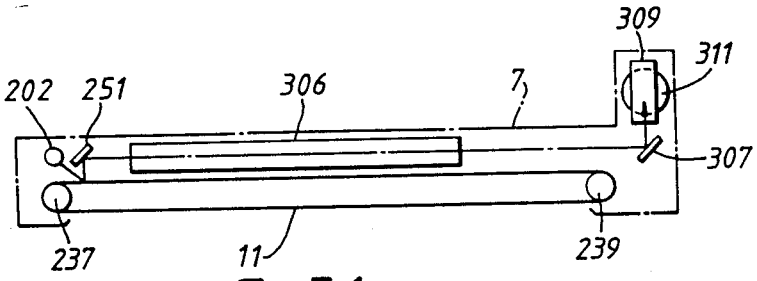
FIG. 34 is a plan view illustrating the optical path shown in FIG. 33.

An illumination lamp 305 is arranged near light illumination opening 303 inside screen device 1. When the document sheet E is taken into transfer path 289, the image formed on the sheet E is illuminated by lamp 305. The light reflected from sheet E is directed to a mirror 306, as shown in FIG. 33, whereupon the light is further led into copy machine 31 by mirror 306 through mirrors 307 and 309 and lens 311. As shown in FIG. 33, mirror 306 is so arranged that it can be moved from position F to position G or vice versa by a suitable drive mechanism (not shown). When the document on screen 11 is copied, mirror 306 is moved to position G. When the document on sheet E is copied, mirror 306 is moved to position F.

Figure 35:
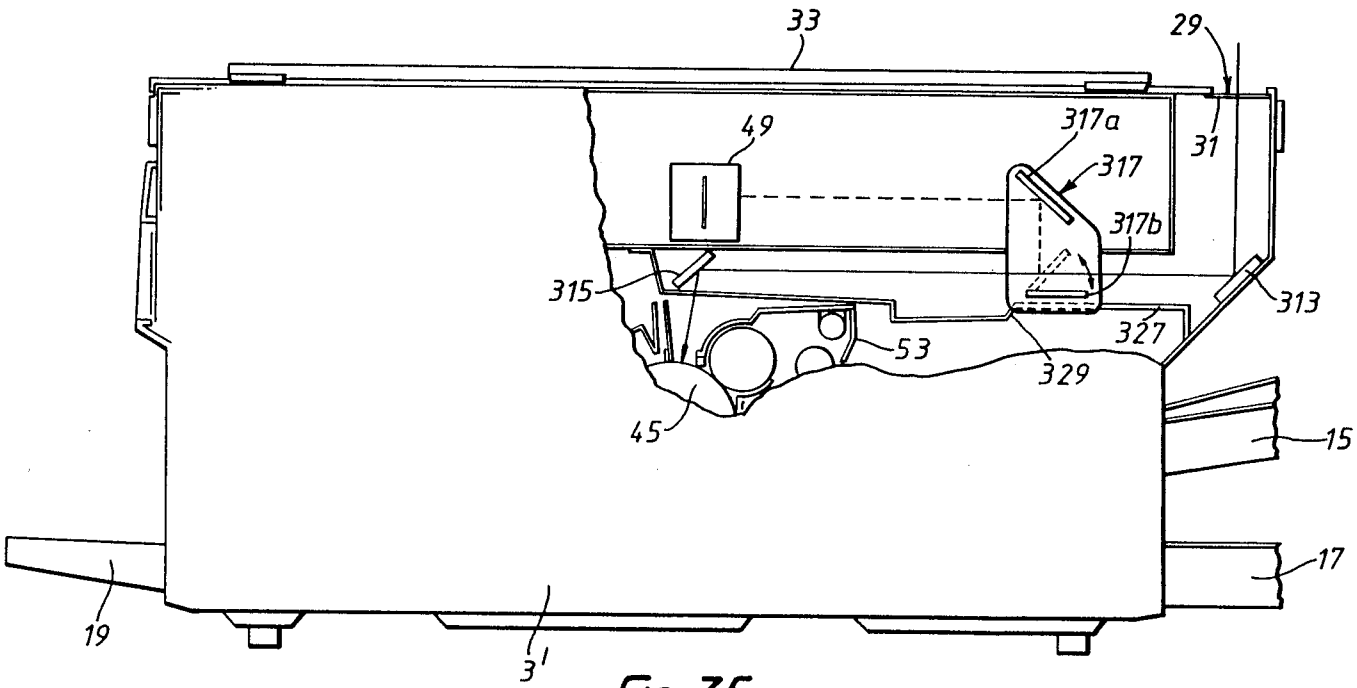
FIG. 35 is a front view partly in section illustrating an image forming device of this embodiment.

As can be seen in FIG. 35, the reflected light directed into copy machine 3' reaches the surface of photosensitive drum 45 by being reflected by mirrors 313 and 315.

Figure 36:
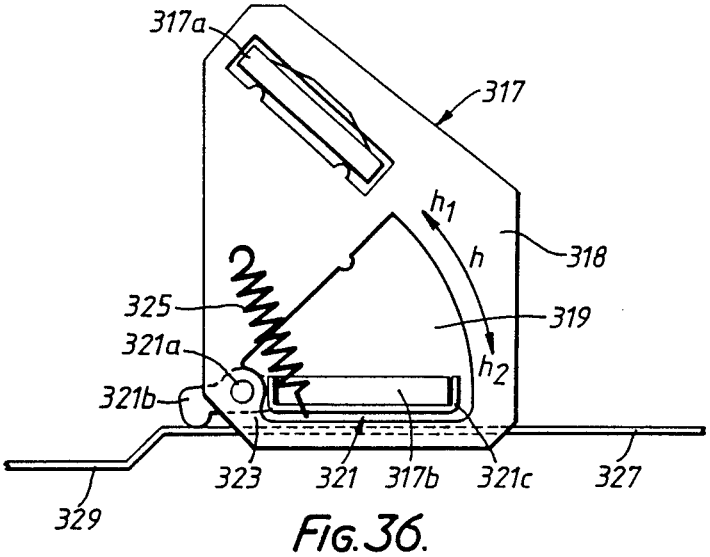
FIGS. 36 and 37 are side views illustrating a mirror arrangement used in the image forming device shown in FIG. 35.
Figure 37:
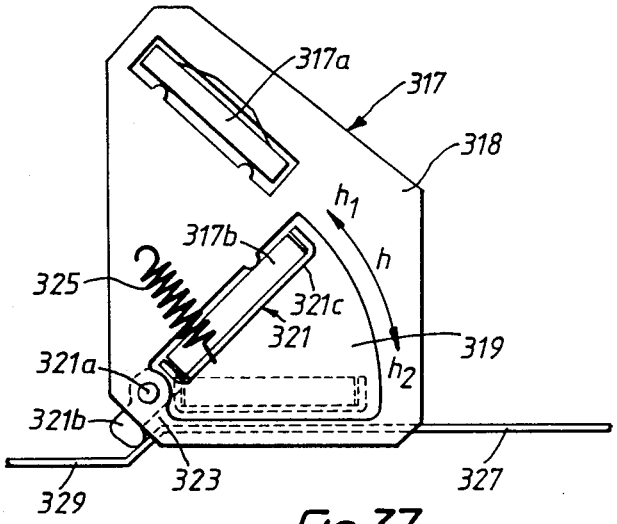

A "V-mirror" block 317 composed of mirrors 317*a* and 317*b* is disposed in the light-path between mirrors 313 and 315. As shown in FIGS. 36 and 37, mirror 317*a* is arranged in the upper part of a mirror holder 318. A sector-shaped opening 319 is provided in the lower part of mirror holder 318. Middle portion 321*a* of a supporting member 321 is movably fixed to the revet portion 323 of sector-shaped opening 319. One end 321*b* of supporting member 321 projects from the edge portion of mirror holder 318, and another end 321*c* extends into sector-shaped opening 319. Thus, end 321*c* of supporting member 321 can be rotated within sector-shaped opening 319 in the directions $h_1$ or $h_2$ of arrow h.

As shown in FIG. 36, since mirror 317*b* is provided at end 321*c* of supporting member 321, mirror 317*b* also can be rotated with supporting member 321. A coiled spring 325 extends between end 321*c* of supporting member 321 and mirror holder 318. Mirror 317*b* is, therefore, maintained in a V-shaped state with mirror 317*a* by coiled spring 325 as shown in FIG. 37. V-mirror block 317 constructed as described above is movably mounted on a separation wall 327, which is provided between developer 53 and the optical unit along the moving direction of mirror block 317 as shown in FIG. 35. A cam depression 329, which is associated with end 321*b* of supporting member 321, is formed to the middle portion of separation wall 327. By the above-described arrangement, when end 321*b* of supporting member 321 is engaged with cam depression 329 of separation wall 327, mirror 317*b* is at the position against coiled spring where it stands out of the light-path between mirrors 313 and 315. Thus, the document formed on screen 11 or sheet E can be copied. When end 321*b* of supporting member 321 is disengaged from cam depression 329 of separation wall 327 by moving V-mirror block 317 to the left as in FIG. 37, one end 321*b* of supporting member 321 is rotated in the direction $h_1$ of arrow h by coiled spring 325, thus mirror 317*b* also is rotated with one end 321*b* of supporting member 321. Under this state, since mirror 317*b* is at the position where it traverses the light-path between mirrors 313 and 315, the light reflected from the document arranged on document table 33 can be reflected by mirrors 317*a* and 317*b*. Thus, the document on document table 33 can be copied.

Figure 38:
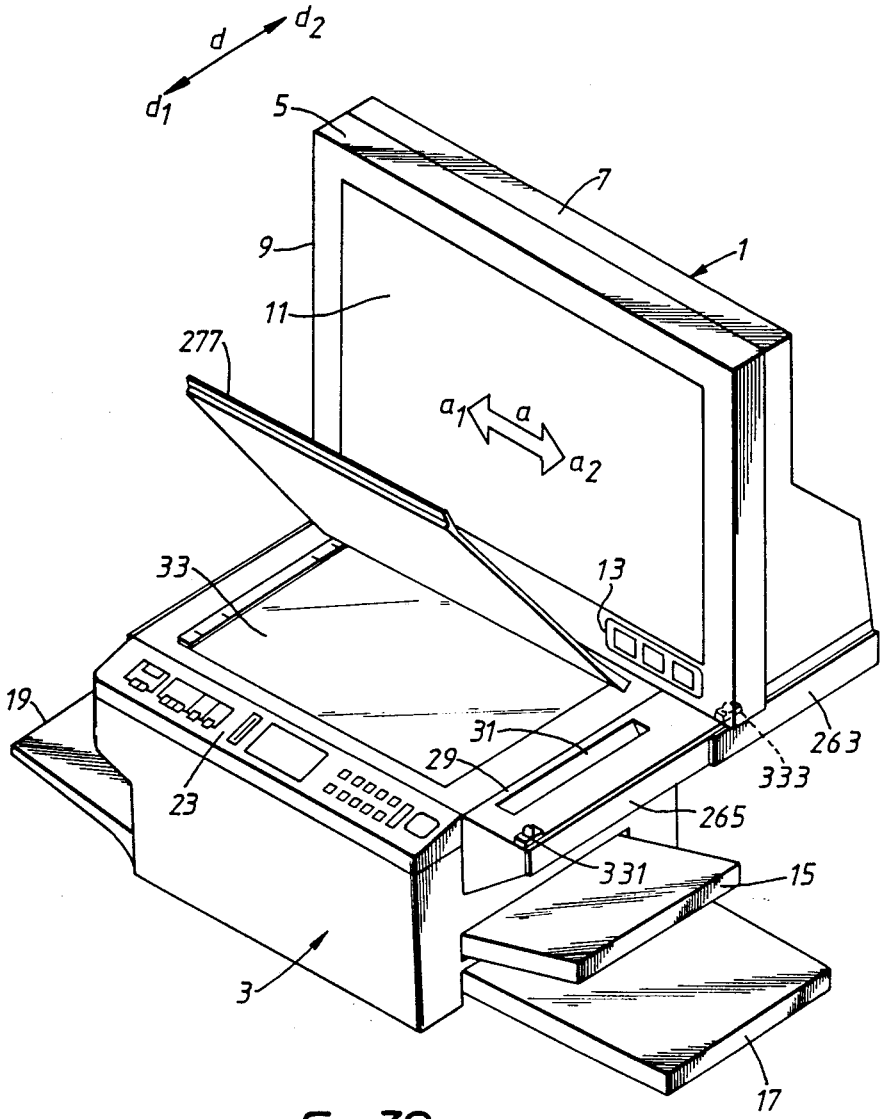
FIG. 38 is a perspective view illustrating an outer appearance of an image forming system having a detection device for detecting positions of the screen device.

According to the fourth embodiment of the present invention, since a carry means is arranged in screen device 1, a large document sheet, the size of which is larger than that of the document on document table 33, can be copied. In the abovedescribed embodiments, although screen is moved horizontally, it may be moved vertically. In addition, as shown in FIG. 38, a detection means may be provided to detect the position of screen device 1. The detection means includes a first switch 331 disposed on the surface of supporting portion $21_1$ at the front of copy machine 3 and a second switch 333 disposed on the surface of supporting portion $21_1$ at rear. When screen device 1 is moved at its front-most position ("screen mode"), first switch 331 can be closed. When screen device 1 is moved at its rear-most position ("conventional mode"), second switch 333 can be closed. Based on the action of switches 331 or 333, the detection means can detect whether screen device 1 is at its appropriate position or not. In addition, mirror 49 (317*b*) may be automatically moved on the basis of the result of the detection In summary, it will be seen that the present invention overcomes the disadvantages of the prior art and provides an improved image forming apparatus which can copy not only the document arranged on the document table of copy machine, but the document formed on the screen of screen device.

Many changes and modifications in the above-described embodiments can be carried out without departing from the scope of the present invention. Therefore, the appended claims should be construed to include all such modifications.

What is claimed is:

1. An image forming system comprising:

a screen device including:

an image support element having a board portion on which an image may be formed, and first scan means for optically scanning an image on said image support element by relatively moving said image support element and said first scan means; and an image forming device to which said screen device is mounted, said image forming device including:

a document support element for supporting a document thereon, a control panel adjoining to said document support element for operating said image forming device therethrough, second scan means for optically scanning the document arranged on said document support element by relatively moving said second scan means and said document support element, means for introducing light reflected from the image on said image support element into said image forming device, forming means, having a common exposure position, for forming an electrostatic charge pattern related to light applied thereto, developing means for developing the electrostatic charge pattern on said forming means, moving means arranged between said screen device and said image forming device for relatively moving said screen device between a screen position in which said board portion of said image support element of said screen device is disposed at a front side adjoining to said control panel of said document support element for copying an image on said image support element and a conventional position in which said board portion of said image support element is disposed at a rear side opposite to the front side of said document support element for copying a document on said document support element, and means responsive to said moving means for selectively applying light to said common exposure position of said forming means reflected from one of the image on said image support element and the document arranged on said document support element.

2. An image forming system according to claim 1, wherein said image forming device further includes a common light path extending between said applying means and said forming means, the light reflected from one of the images on said image support element and said document arranged on said document support element being selectively applied to said common exposure position of said forming means along said common light path.

3. The image forming system according to claim 1, wherein said screen device includes optical means for directing light reflected from the image on said image support element to said introducing means.

4. The image forming system according to claim 3, wherein said optical means includes focus means for focusing light reflected from the image on said image support element onto said forming means.

5. The image forming system according to claim 4, wherein said optical means includes a first optical unit, a second optical unit, and hinge means for rotatably joining said second optical unit to said first optical unit.

6. The image forming system according to claim 4, wherein said image forming device includes second optical means for directing light reflected from a document arranged on said document support element to said applying means.

7. The image forming system according to claim 6, wherein said second optical means includes second focus means for focusing light reflected from a document arranged on said document support element onto said forming means.

8. The image forming system according to claim 7, wherein said applying means includes mirror means rotatable between a first position for permitting light reflected from the image on said image support element through said introducing means to be directed to said forming means and a second position for permitting light reflected from a document arranged on said document support element to be directed to said forming means.

9. The image forming system according to claim 6, wherein said screen device includes conveyance means for conveying a document sheet to be copied.

10. The image forming system according to claim 9, further including third scan means for optically scanning said document sheet carried by said conveyance means.

11. The image forming system according to claim 10, further including third optical means for directing light reflected from said document sheet to said introducing means.

12. The image forming system according to claim 1, wherein said image forming device includes a detection means for detecting the position of said screen device relative to said screen position and said conventional position.

13. The image forming system according to claim 1, wherein said image forming device includes drive means for driving said moving means.

14. The image forming system according to claim 1, wherein said screen device includes drive means for driving said moving means.

15. The image forming system according to claim 1, wherein said image support element includes a pair of rotatable hubs which are arranged apart from one another and a screen windably supported between said hubs.

16. The image forming system according to claim 15, wherein said forming means includes a rotatable drum.

17. The image forming system according to claim 16, wherein said screen device includes a synchronous drive means to wind said screen in synchronism with the rotation of said drum when an image formed on said image support element is scanned by the first scan means.

* * * * *